US010359043B2

(12) United States Patent
Miyatake

(10) Patent No.: US 10,359,043 B2
(45) Date of Patent: Jul. 23, 2019

(54) OIL-FREE SCREW COMPRESSOR

(71) Applicant: Kabushiki Kaisha Kobe Seiko Sho (Kobe Steel, Ltd.), Hyogo (JP)

(72) Inventor: Toshiyuki Miyatake, Hyogo (JP)

(73) Assignee: Kabushiki Kaisha Kobe Seiko Sho (Kobe Steel, Ltd.), Hyogo (JP)

( * ) Notice: Subject to any disclaimer, the term of this patent is extended or adjusted under 35 U.S.C. 154(b) by 290 days.

(21) Appl. No.: 15/513,144

(22) PCT Filed: Sep. 24, 2015

(86) PCT No.: PCT/JP2015/076917
§ 371 (c)(1),
(2) Date: Mar. 21, 2017

(87) PCT Pub. No.: WO2016/052298
PCT Pub. Date: Apr. 7, 2016

(65) Prior Publication Data

US 2017/0306958 A1 Oct. 26, 2017

(30) Foreign Application Priority Data

Sep. 29, 2014 (JP) ..... 2014-199197

(51) Int. Cl.
*F01C 19/00* (2006.01)
*F04C 18/00* (2006.01)
(Continued)

(52) U.S. Cl.
CPC ..... *F04C 27/009* (2013.01); *F01C 21/02* (2013.01); *F04C 18/16* (2013.01); *F04C 29/02* (2013.01);
(Continued)

(58) Field of Classification Search
CPC ..... F04C 18/16; F04C 27/00; F04C 27/02; F04C 27/009; F04C 29/02; F04C 2220/12;
(Continued)

(56) References Cited

U.S. PATENT DOCUMENTS 4,487,563 A * 12/1984 Mori ..... F04C 27/009 418/104
4,781,553 A * 11/1988 Nomura ..... F04C 27/009 418/104
(Continued)

FOREIGN PATENT DOCUMENTS

JP S58-193997 A 11/1983
JP S61-027985 U 2/1986
(Continued)

OTHER PUBLICATIONS

Translation of International Preliminary Report on Patentability issued in PCT/JP2015/076917; dated Apr. 13, 2017; 10p.
(Continued)

*Primary Examiner* — Theresa Trieu
(74) *Attorney, Agent, or Firm* — Studebaker & Brackett PC

(57) ABSTRACT

An oil-free screw compressor has a screw rotor including a screw and a shaft, a bearing supporting the shaft, a first shaft seal device disposed between the screw and the bearing and including a first seal opposite to the shaft, and a first communication portion communicating the inner periphery face and the outer peripheral face of the first shaft seal device, a second shaft seal device disposed between the first shaft seal device and the bearing and including a second seal opposite to the shaft, and a second communication portion communicating an inner periphery face and the outer peripheral face of the second shaft seal device, and a casing including an atmosphere communication portion connected
(Continued)

to both of the first communication portion and the second communication portion on the inner peripheral face of a shaft accommodation space.

9 Claims, 14 Drawing Sheets

(51) Int. Cl.

| | |
|---|---|
| ***F04C 27/00*** | (2006.01) |
| ***F16J 15/00*** | (2006.01) |
| ***F04C 18/16*** | (2006.01) |
| ***F04C 29/02*** | (2006.01) |
| ***F01C 21/02*** | (2006.01) |

(52) U.S. Cl.
CPC ..... *F04C 2240/30* (2013.01); *F04C 2240/50* (2013.01); *F04C 2240/60* (2013.01); *F04C 2240/605* (2013.01)

(58) Field of Classification Search
CPC ..... F04C 2230/21; F04C 2240/30; F04C 2240/50; F04C 2240/60; F04C 2240/605; F01C 21/02; F04B 39/00; F16J 15/441; F16J 15/40
USPC ..... 418/97–99, 102, 104, 141, 201.1; 277/351, 412, 431, 432, 927; 184/6.16
See application file for complete search history.

(56) References Cited

U.S. PATENT DOCUMENTS

| | | | | |
|---|---|---|---|---|
| 5,727,936 | A * | 3/1998 | Eriksson | F04C 27/009 418/104 |
| 5,957,676 | A * | 9/1999 | Peeters | C10M 171/008 184/6.16 |
| 2008/0240964 | A1* | 10/2008 | Kimura | F04C 27/009 418/104 |
| 2011/0135528 | A1* | 6/2011 | Amano | F04C 18/16 418/201.1 |

FOREIGN PATENT DOCUMENTS

| | | | |
|---|---|---|---|
| JP | S61-144289 | U | 9/1986 |
| JP | 2012-127314 | A | 7/2012 |

OTHER PUBLICATIONS

International Search Report issued in PCT/JP2015/076917; dated Dec. 28, 2015.

* cited by examiner

OIL-FREE SCREW COMPRESSOR

CROSS-REFERENCE TO RELATED APPLICATIONS

This is a national phase application in the United States of International Patent Application No. PCT/JP2015/076917 with an international filing date of Sep. 24, 2015, which claims a priority of Japanese Patent Application No. 2014-199197 filed on Sep. 29, 2014, the contents of which is incorporated herein by reference.

TECHNICAL FIELD

The present invention relates to an oil-free screw compressor.

BACKGROUND ART

An oil-free screw compressor in which lubricating oil (oil) is not supplied to between a screw of a male screw rotor and a screw of a female screw rotor, which engage with each other, has been used. In such an oil-free screw compressor, lubricating oil that has been supplied to bearings supporting shafts of the screw rotors is prevented from intruding into a rotor chamber accommodating the screws of the screw rotors. In particular, when a negative pressure is generated in the rotor chamber during an unload operation (an operation in a state where suction into the screw compressor is limited), the lubricating oil in the bearings is prevented from intruding into the rotor chamber.

For instance, an oil-free screw compressor described in JP S61-144289 U has a first shaft seal device and a second shaft seal device in a tubular shape that are fitted on a shaft of a screw rotor and are disposed between a screw of the screw rotor and a bearing. The first shaft seal device is disposed on the screw side of the screw rotor, and has a seal provided on the inner peripheral face of the first shaft seal device, and a communication portion provided on the bearing side with respect to the seal and communicating between the inner peripheral face side and the outer peripheral face side of the first shaft seal device. The second shaft seal device is disposed on the bearing side of the first shaft seal device, and has a seal provided on the inner peripheral face of the second shaft seal device, and a communication portion provided on the screw side of the screw rotor with respect to the seal and communicating between the inner peripheral face side and the outer peripheral face side of the second shaft seal device. The communication portion of the first shaft seal device communicates with the atmosphere outside of a casing accommodating the screw rotor via a first atmosphere communication portion formed in the casing. The communication portion of the second shaft seal device communicates with the atmosphere outside of the casing via a second atmosphere communication portion formed in the casing.

By a negative pressure generated in the rotor chamber during the unload operation, the atmosphere outside of the casing flows in through the communication portion of the first shaft seal device. However, when the atmosphere outside of the casing flows in only through the communication portion of the first shaft seal device, a negative pressure is generated in the seal on the inner peripheral face of the second shaft seal device, resulting in the possibility of intruding a small amount of lubricating oil into the rotor chamber. To eliminate the negative pressure generated in the seal for preventing intrusion of the lubricating oil, the atmosphere outside of the casing also flows in through the communication portion of the second shaft seal device.

SUMMARY OF THE INVENTION

Problems to be Solved by the Invention

The oil-free screw compressor described in JP S61-144289 U is complicated in configuration in that the first atmosphere communication portion and the second atmosphere communication portion are formed in the casing, and is thus difficult to manufacture.

The first atmosphere communication portion and the second atmosphere communication portion are formed in the casing so as not to interfere with each other by making their positions in the extension direction of the rotation center line of the screw rotor different. This limits disposition of the communication portion of the first shaft seal device and the communication portion of the second shaft seal device, which communicate with the atmosphere communication portions, in such a manner that they are close to each other in the extension direction of the rotation center line of the screw rotor. That is, the distance between the communication portion of the first shaft seal device and the communication portion of the second shaft seal device inevitably becomes long. With this, the distance between the screw of the screw rotor and the bearing (in other words, the distance between two bearings supporting the shafts on both sides of the screw) also inevitably becomes long.

As a result, the screw rotor (in particular, the shaft) is likely to bend. When the screw rotor bends, the performance, e.g., volumetric efficiency, of the screw compressor is lowered.

Accordingly, the present invention provides an oil-free screw compressor that is easy to manufacture and prevents bending of a screw rotor.

Means for Solving the Problems

To solve the above technical problems, a first aspect of the present invention provides an oil-free screw compressor including a screw rotor including a screw and a shaft, a bearing supporting the shaft, a first shaft seal device fitted on the shaft, disposed between the screw and the bearing, and including a first seal opposite to the shaft, and a first communication portion communicating the bearing side with respect to between the shaft and the first seal and the outer peripheral face of the first shaft seal device, a second shaft seal device fitted on the shaft, disposed between the first shaft seal device and the bearing, and including a second seal opposite to the shaft, and a second communication portion communicating the screw side with respect to between the shaft and the second seal and the outer peripheral face of the second shaft seal device, and a casing including a rotor chamber accommodating the screw, and a shaft accommodation space accommodating the shaft, the bearing, the first shaft seal device, and the second shaft seal device, in which the casing includes an atmosphere communication portion connected to both of the first communication portion and the second communication portion on the inner peripheral face of the shaft accommodation space, and communicating the first communication portion and the second communication portion with the atmosphere.

As compared with a case that an atmosphere communication portion for communicating the first communication portion of the first shaft seal device with the atmosphere and an atmosphere communication portion for communicating the second communication portion of the second shaft seal device with the atmosphere are formed in the casing, that is, as compared with a case that two atmosphere communication portions are formed in the casing, the casing is simple in configuration, whereby the oil-free screw compressor is easy to manufacture.

In addition, both of the first communication portion of the first shaft seal device and the second communication portion of the second shaft seal device communicate with the atmosphere via one atmosphere communication portion. Thus, as compared with a case that the atmosphere communication portion for communicating the first communication portion of the first shaft seal device with the atmosphere and the atmosphere communication portion for communicating the second communication portion of the second shaft seal device with the atmosphere are formed in the casing, the distance between the first communication portion and the second communication portion can be short. With this, the distance between the screw rotor and the bearing can also be short. As a result, bending of the screw rotor can be prevented.

Effect of the Invention

The oil-free screw compressor of the present invention is easy to manufacture, and prevents bending of the screw rotor.

BRIEF DESCRIPTION OF THE DRAWINGS

These aspects and features of the present invention will be apparent from the following description in connection with preferred embodiments with reference to the accompanying drawings. In these drawings.

MODE FOR CARRYING OUT THE INVENTION

Embodiments will now be described in detail with reference to the drawings when necessary. In some cases, the description of the embodiments is not excessively detailed. For instance, the detailed description of already well-known matters and the overlapped description of substantially the same configuration are sometimes omitted. This is for avoiding the following description from being excessively redundant and for enabling those skilled in the art to easily understand the embodiments.

The present inventor(s) provide(s) the drawings and the following description so that those skilled in the art sufficiently understand the embodiments, and these do not intend to limit the subject described in the claims.

The embodiments of the present invention will now be described with reference to the drawings.

Figure 1:
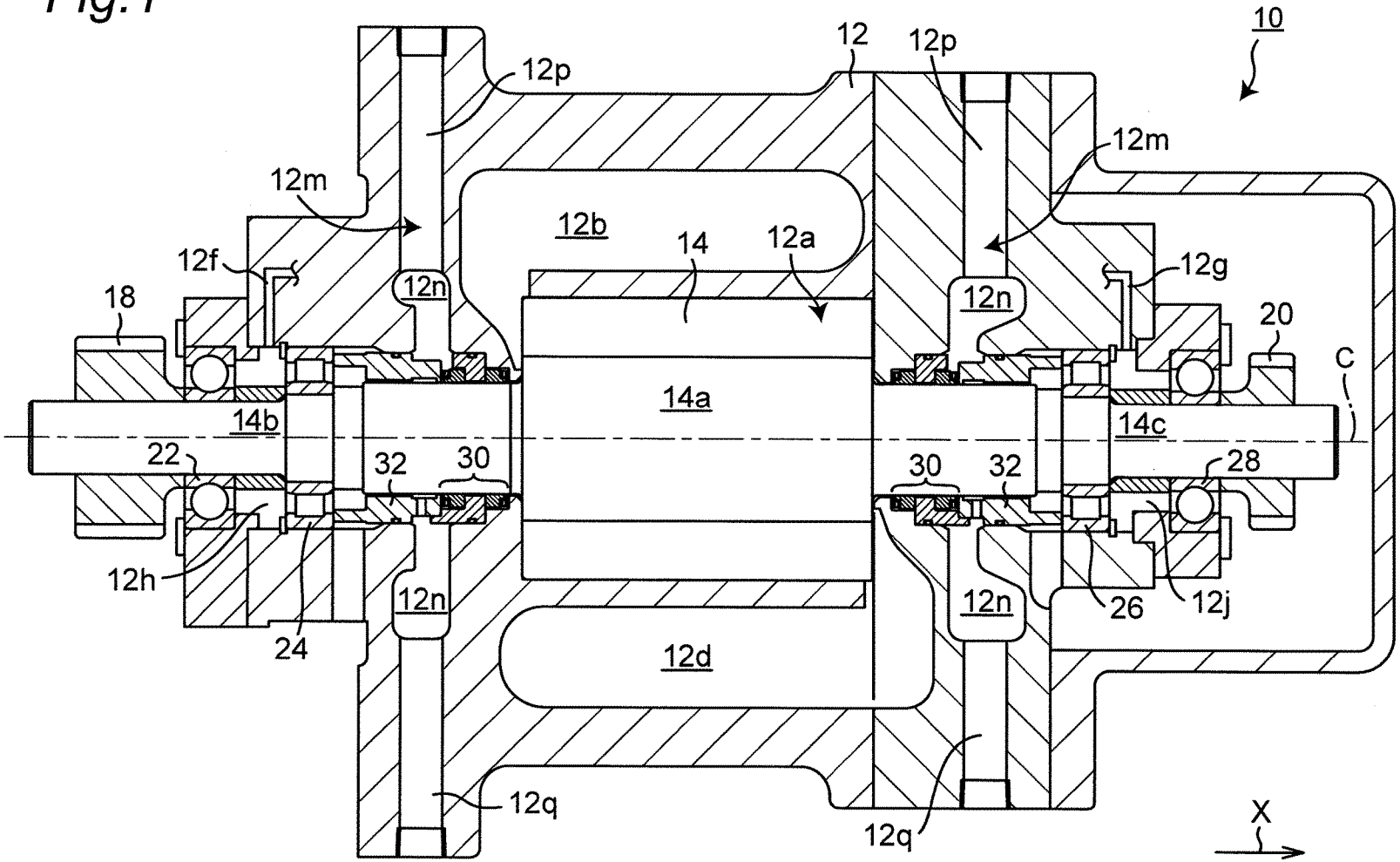
FIG. 1 is a schematic sectional view illustrating the interior of an oil-free screw compressor according to an embodiment of the present invention.
Figure 2:
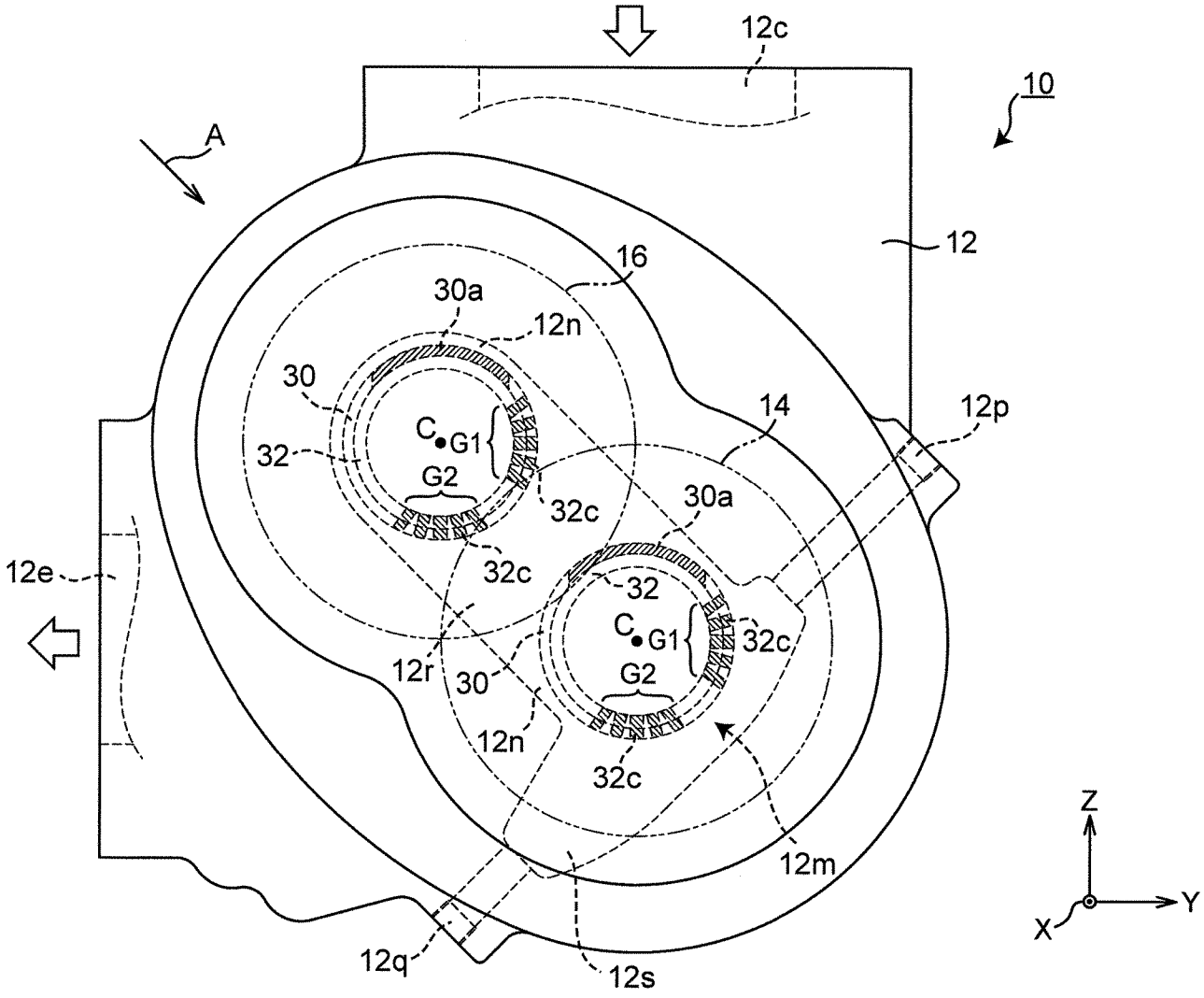
FIG. 2 is a schematic front view of the oil-free screw compressor seen in the extension direction of the rotation center line of each screw rotor.

FIG. 1 is a schematic sectional view illustrating the interior of an oil-free screw compressor (hereinafter, referred to as a "screw compressor") according to an embodiment of the present invention. FIG. 2 is a schematic front view of a screw compressor 10 seen in the extension direction (X-axis direction) of the rotation center line of each screw rotor of the screw compressor, and illustrates disposition of some components. FIG. 1 is a cross-sectional view of the screw compressor seen in the direction indicated by arrow A in FIG. 2.

As illustrated in FIGS. 1 and 2, the screw compressor 10 has a casing 12. The screw compressor 10 also has a male screw rotor 14 and a female screw rotor 16 accommodated in the casing 12.

Portions of the male screw rotor 14 and the female screw rotor 16 except for their screws engaging with each other in a state where they are not in contact with each other are substantially the same. Therefore, the screw compressor 10 will be described by focusing on the male screw rotor 14, and the description of the female screw rotor 16 is omitted.

As illustrated in FIG. 1, the male screw rotor 14 has a screw 14*a*, and shafts 14*b* and 14*c* provided at both ends of the screw 14*a* (at both ends in the extension direction of rotation center line C thereof).

The screw 14*a* of the male screw rotor 14 is accommodated in a rotor chamber 12*a* of the casing 12 together with a screw of the female screw rotor 16 (not illustrated). The rotor chamber 12*a* communicates with a suction port 12*c* formed in the outer face of the casing 12 via a suctioning flow passage 12*b* formed in the casing 12 in order to suck air thereinto. The rotor chamber 12*a* also communicates with a discharge port 12*e* via a discharging flow passage 12*d* in order to discharge air that has been compressed by the male screw rotor 14 and the female screw rotor 16, to the outside of the casing 12.

On the end side of the shaft 14*b* of the male screw rotor 14 (on the left side in FIG. 1), a drive gear 18 is mounted. The drive gear 18 is rotatably driven by a motor (not illustrated).

On the end side of the shaft 14*c* of the male screw rotor 14 (on the right side in FIG. 1), a timing gear 20 is mounted. A timing gear engaging with the timing gear 20 (not illustrated) is mounted on a shaft of the female screw rotor 16 extending in parallel with the shaft 14*c* of the male screw rotor 14 (not illustrated).

The male screw rotor 14 is rotatably supported by a plurality of bearings 22, 24, 26, and 28. In this embodiment, the ball bearing 22 is disposed on the end side of the shaft 14*b*, the ball bearing 28 is disposed on the end side of the shaft 14*c*, and the roller bearings 24 and 26 are disposed on the screw 14*a* side.

In the casing 12, formed are a lubricating flow passage 12*f* for supplying lubricating oil to the bearings 22 and 24 and a lubricating flow passage 12*g* for supplying lubricating oil to the bearings 26 and 28. Specifically, in the casing 12, formed are a shaft accommodation space 12*h* accommodating the shaft 14*b* of the male screw rotor 14 and the bearings 22 and 24 and a shaft accommodation space 12*j* accommodating the shaft 14*c* of the male screw rotor 14 and the bearings 26 and 28. The lubricating flow passage 12*f* is formed in the casing 12 so as to supply lubricating oil into the portion of the shaft accommodation space 12*h* between the bearings 22 and 24 fitted on the shaft 14*b*. The lubricating flow passage 12*g* is formed in the casing 12 so as to supply lubricating oil into the portion of the shaft accommodation space 12*j* between the bearings 26 and 28 fitted on the shaft 14*c*. The lubricating flow passages 12*f* and 12*g* are connected to a discharge port of an oil pump discharging lubricating oil (not illustrated).

When the drive gear 18 is rotated by the motor (not illustrated), the male screw rotor 14 rotates, and the female screw rotor 16 rotates via the timing gear 20. This sucks air via the suction port 12*c* into the rotor chamber 12*a*, and the sucked air is then compressed by the male screw rotor 14 and the female screw rotor 16, which rotate synchronously. The compressed air is discharged to the outside of the casing 12 via the discharge port 12*e*.

In the screw compressor 10, the compressed air in the rotor chamber 12*a* is prevented from leaking to the outside (shaft accommodation spaces 12*h* and 12*j*), and the lubricating oil in the plurality of bearings 22, 24, 26, and 28 is prevented from intruding into the rotor chamber 12*a*. Specifically, as illustrated in FIG. 1, the screw compressor 10 has first shaft seal devices 30 for preventing leakage of the compressed air in the rotor chamber 12*a* to the outside, and second shaft seal devices 32 for preventing intrusion of the lubricating oil into the rotor chamber 12*a*.

As illustrated in FIG. 1, the first shaft seal device 30 and the second shaft seal device 32 in a tubular shape capable of being fitted on the shaft 14*b* of the male screw rotor 14 are disposed between the bearing 24 and the rotor chamber 12*a*, whereas the first shaft seal device 30 and the second shaft seal device 32 in a tubular shape capable of being fitted on the shaft 14*c* of the male screw rotor 14 are disposed between the bearing 26 and the rotor chamber 12*a*. The first shaft seal devices 30 are disposed on the rotor chamber 12*a* side with respect to the second shaft seal devices 32.

From here, the detail of the first shaft seal device 30 and the second shaft seal device 32 will be described. The first shaft seal device 30 and the second shaft seal device 32 fitted on the shaft 14*b* of the male screw rotor 14 is substantially the same as the first shaft seal device 30 and the second shaft seal device 32 fitted on the shaft 14*c* of the male screw rotor 14. Thus, hereinafter, the screw compressor 10 will be described by focusing on the first shaft seal device 30 and the second shaft seal device 32 fitted on the shaft 14*c* of the male screw rotor 14 (on the timing gear 20 side of the male screw rotor 14).

Figure 3:
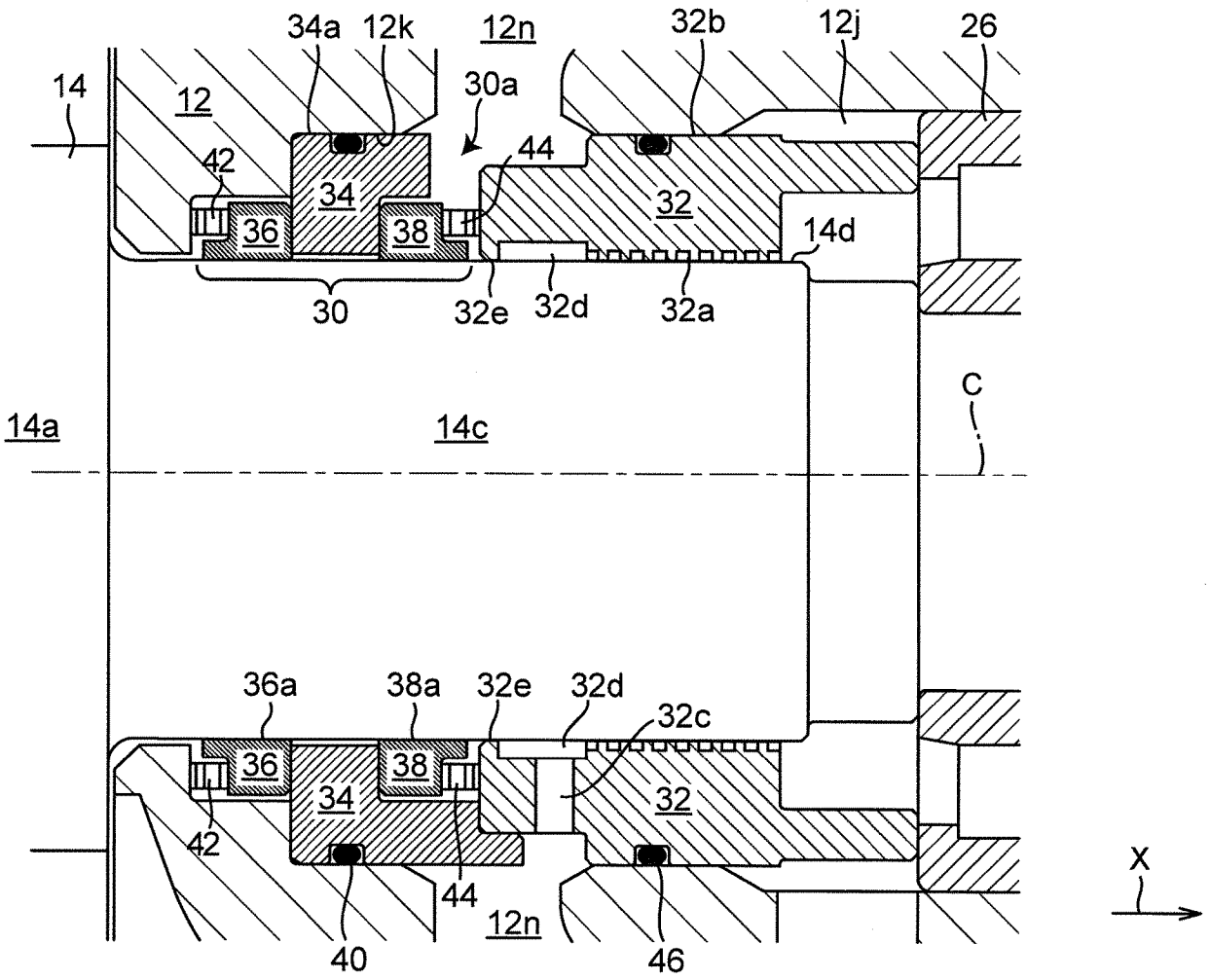
FIG. 3 is a partial enlarged view of FIG. 1.
Figure 4:
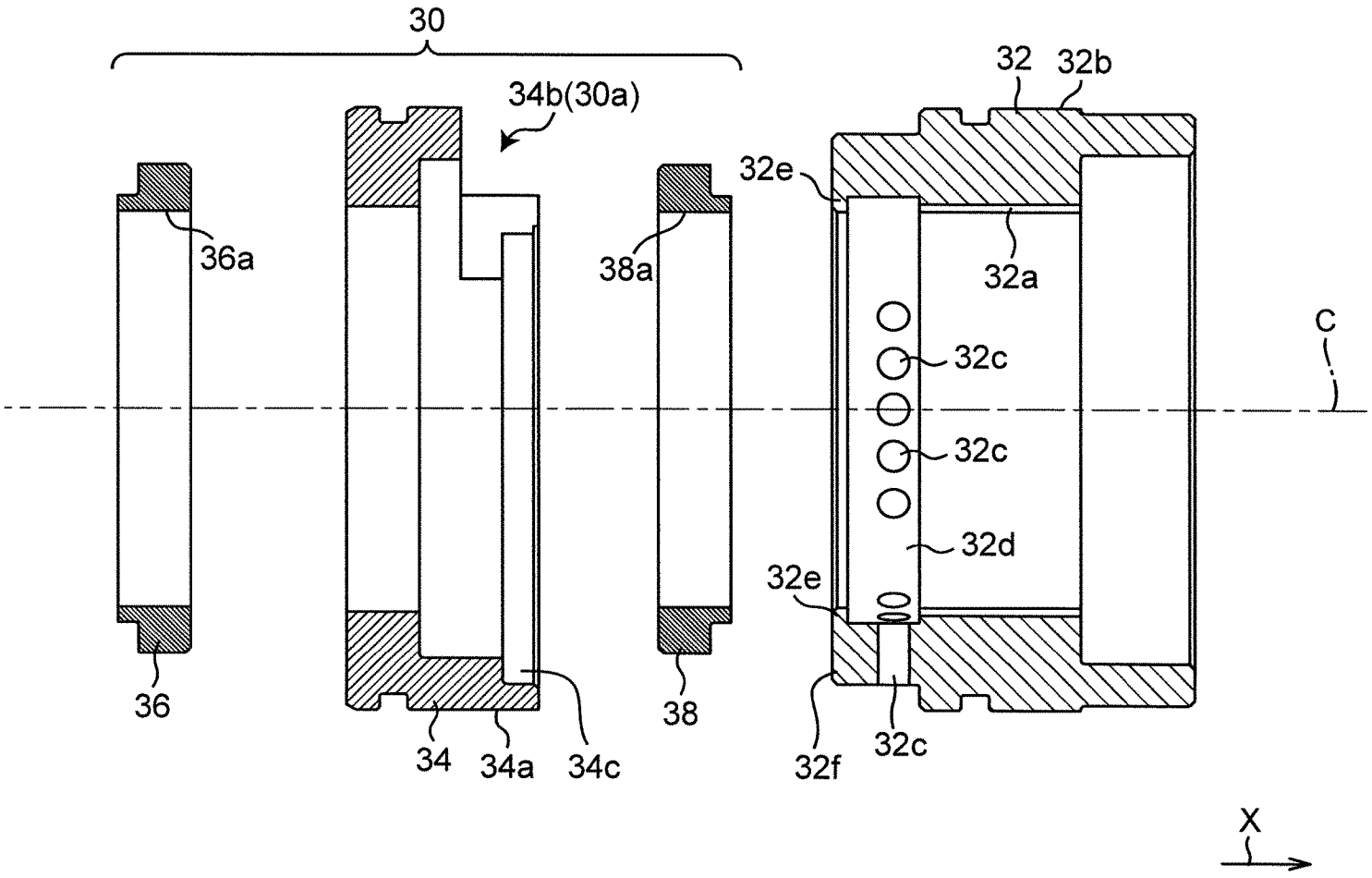
FIG. 4 is an exploded sectional view of a first shaft seal device and a second shaft seal device.

FIG. 3 is a partial enlarged view of FIG. 1, and illustrates the first shaft seal device 30 and the second shaft seal device 32 in a state where they are fitted on the shaft 14*c* of the male screw rotor 14 on the timing gear 20 side. FIG. 4 illustrates the first shaft seal device 30 and the second shaft seal device 32 in a state where they are removed from the shaft 14*c*.

As illustrated in FIGS. 3 and 4, in this embodiment, the first shaft seal device 30 has a tubular main body 34, and two seal rings 36 and 38.

As illustrated in FIG. 3, the tubular main body 34 of the first shaft seal device 30 is fitted on the shaft 14*c* of the male screw rotor 14. In addition, the main body 34 includes an outer peripheral face 34*a* opposite to an inner peripheral face 12*k* of the shaft accommodation space 12*j* of the casing 12. Further, an annular resilient member 40 (e.g., O-ring) is fitted on the outer peripheral face 34*a* of the main body 34 in order to seal between the inner peripheral face 12*k* of the shaft accommodation space 12*j* and the outer peripheral face 34*a*.

The two seal rings 36 and 38 are fitted on the shaft 14*c* of the male screw rotor 14. In addition, the seal ring 36 includes, on its inner peripheral face, a seal 36*a* (first seal) opposite to an outer peripheral face 14*d* of the shaft 14*c*, and the seal ring 38 includes, on its inner peripheral face, a seal 38*a* (first seal) opposite to the outer peripheral face 14*d* of the shaft 14*c*. For instance, the seals 36*a* and 38*a* are seal faces. The seal 36*a* seals between the seal ring 36 and the outer peripheral face 14*d* of the shaft 14*c*, and the seal 38*a* seals between the seal ring 38 and the outer peripheral face 14*d* of the shaft 14*c*.

As illustrated in FIG. 3, the main body 34 of the first shaft seal device 30 is disposed between the two seal rings 36 and 38. To maintain the contact between the seal rings 36 and 38 and the main body 34, the seal ring 36 is biased toward the main body 34 by a biasing member 42, and the seal ring 38 is biased toward the main body 34 by a biasing member 44. The biasing member 42 is disposed between the casing 12 and the seal ring 36, and the biasing member 44 is disposed between the seal ring 38 and the second shaft seal device 32. The biasing members 42 and 44 are e.g., wave springs. This seals between the main body 34 and the seal rings 36 and 38.

The first shaft seal device 30 prevents leakage of compressed air in the rotor chamber 12*a* into the shaft accommodation space 12*j*, and the compressed air in the rotor chamber 12*a* flows via the discharging flow passage 12*d* toward the discharge port 12*e*.

As illustrated in FIGS. 3 and 4, in this embodiment, the second shaft seal device 32 is a tubular member having an integrated configuration, and can be fitted on the shaft 14*c* of the male screw rotor 14. The second shaft seal device 32 in a tubular shape also includes, on its inner peripheral face, a seal 32*a* (second seal) opposite to the outer peripheral face 14*d* of the shaft 14*c*. In this embodiment, the seal 32*a* is a visco seal. The second shaft seal device 32 further includes an outer peripheral face 32*b* opposite to the inner peripheral face 12*k* of the shaft accommodation space 12*j* of the casing 12. On the outer peripheral face 32*b*, an annular resilient member 46 (e.g., O-ring) is fitted in order to seal between the inner peripheral face 12*k* of the shaft accommodation space 12*j* and the outer peripheral face 32*b*.

The second shaft seal device 32 prevents intrusion of lubricating oil that has been supplied via the lubricating flow passage 12*g* to the bearings 26 and 28, into the rotor chamber 12*a*, as illustrated in FIG. 1.

In addition to use of the first shaft seal device 30 and the second shaft seal device 32, in the screw compressor 10, leakage of compressed air from the rotor chamber 12*a* and intrusion of lubricating oil into the rotor chamber 12*a* are prevented more effectively.

For instance, when the male screw rotor 14 (and the female screw rotor 16) rotates at high speed, there is a possibility that compressed air in the rotor chamber 12*a* passes through between the first shaft seal device 30 and the shaft 14*b* that is rotating at high speed and through between the first shaft seal device 30 and the shaft 14*c* that is rotating at high speed. In addition, for instance, when the screw compressor 10 is in an unload operation, that is, when flow of air into the suction port 12*c* is limited, the rotor chamber 12*a* has a negative pressure therein, and as a result, there is a possibility that lubricating oil in the bearings 22 and 24 passes through between the second shaft seal device 32 and the shaft 14*b* and then passes through between the first shaft seal device 30 and the shaft 14*b* to intrude into the rotor chamber 12*a*, whereas there is a possibility that lubricating oil in the bearings 26 and 28 passes through between the second shaft seal device 32 and the shaft 14*c* and then passes through between the first shaft seal device 30 and the shaft 14*c* to intrude into the rotor chamber 12*a*.

In consideration of these possibilities, in this embodiment, in the screw compressor 10, compressed air that has passed through between the first shaft seal device 30 and the male screw rotor 14 and lubricating oil that has passed through between the second shaft seal device 32 and the male screw rotor 14 are discharged to the outside of the casing 12.

For that, as illustrated in FIG. 3, the first shaft seal device 30 includes a communication portion 30*a* (first communication portion) communicating the portion of the inner peripheral face thereof on the bearing 26 side with respect to the seal 38*a* with the outer peripheral face thereof. The second shaft seal device 32 includes a communication portion 32*c* (second communication portion) communicating the portion of the inner peripheral face thereof on the screw 14*a* side with respect to the seal 32*a* with the outer peripheral face thereof.

Figure 5:
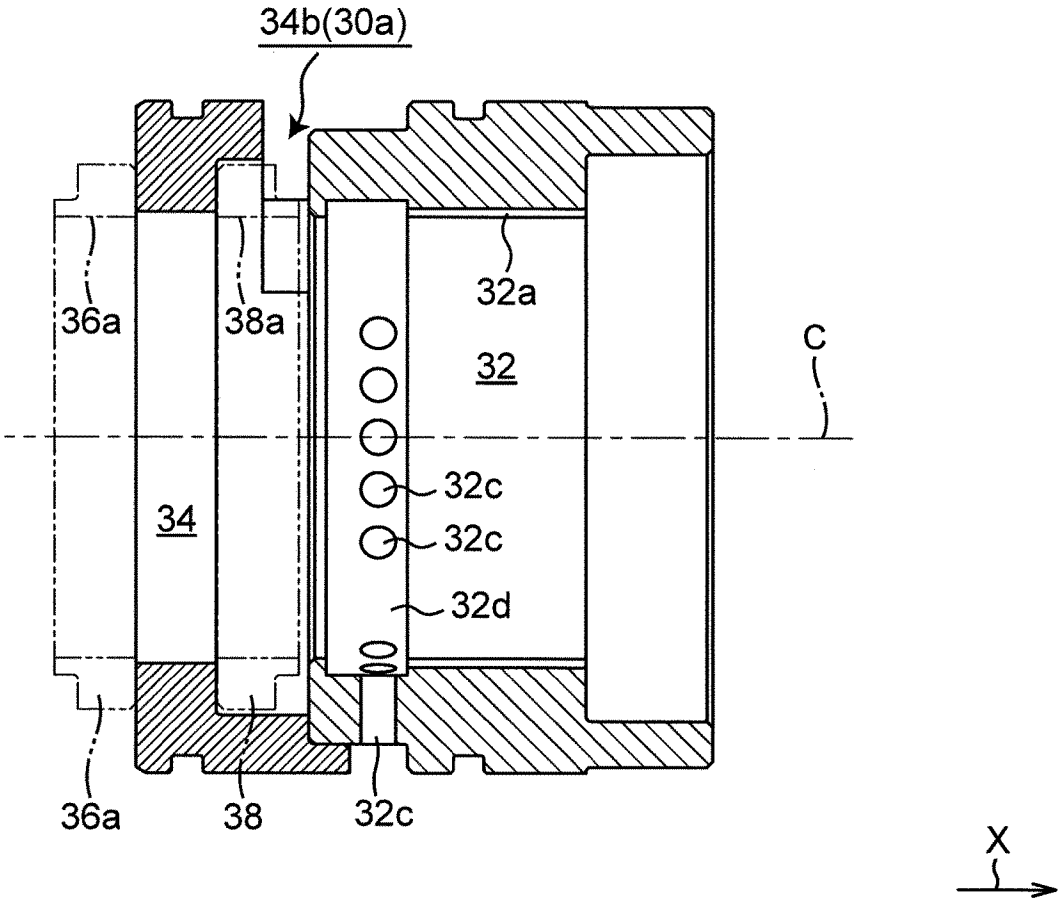
FIG. 5 is a cross-sectional view illustrating the engaged state of the first shaft seal device and the second shaft seal device.

Specifically, in this embodiment, as illustrated in FIG. 5, the first shaft seal device 30 and the second shaft seal device 32 in a tubular shape are disposed so as to engage with each other in the extension direction (X-axis direction) of rotation center line C of the male screw rotor 14. For instance, as illustrated in FIG. 4, at the end of the first shaft seal device 30 on the second shaft seal device 32 side, a recess 34*c* with which an end 32*f* of the second shaft seal device 32 on the first shaft seal device 30 side engages is formed. With this, as illustrated in FIG. 5, the first shaft seal device 30 and the second shaft seal device 32 engage with each other so as to overlap with each other when seen in the diameter direction of the male screw rotor 14. The first shaft seal device 30 and the second shaft seal device 32 engage with each other so as not to change the angular positions thereof about rotation center line C of the male screw rotor 14.

In this embodiment, as illustrated in FIG. 4, the communication portion 30*a* of the first shaft seal device 30 includes a cutaway portion 34*b* formed in the end face of the main body 34 on the bearing 26 side (on the second shaft seal device 32 side). Also referring to FIG. 5, when the first shaft seal device 30 and the second shaft seal device 32 engage with each other to configure one tubular structural body, a slot-shaped through hole is formed in the tubular structural body by the cutaway portion 34*b*. The slot-shaped through hole functions as the communication portion 30*a* of the first shaft seal device 30.

In this embodiment, the communication portion 32*c* of the second shaft seal device 32 includes a plurality of through holes. Specifically, in the inner peripheral face of the second shaft seal device 32, an annular groove 32*d* is formed on the screw 14*a* side of the male screw rotor 14 (on the first shaft seal device 30 side) with respect to the seal 32*a*. A plurality of through hole-shaped communication portions 32*c* extend from the bottom of the annular groove 32*d* to the outer peripheral face side of the second shaft seal device 32.

To communicate the communication portion 30*a* of the first shaft seal device 30 and the plurality of communication portions 32*c* of the second shaft seal device 32 with the atmosphere, the casing 12 includes an atmosphere communication portion 12*m*.

In this embodiment, the atmosphere communication portion 12*m* includes a connection space 12*n*, and external communication portions 12*p* and 12*q*. As illustrated in FIG. 3, the connection space 12*n* is formed in a recess shape in the inner peripheral face 12*k* of the shaft accommodation space 12*j* so as to be connected to both of the communication portion 30*a* of the first shaft seal device 30 and the communication portions 32*c* of the second shaft seal device 32. As illustrated in FIG. 1, the external communication portions 12*p* and 12*q* communicate the connection space 12*n* with the atmosphere outside of the casing 12.

In this embodiment, the connection space 12*n* of the atmosphere communication portion 12*m* is a recess formed in the inner peripheral face 12*k* of the shaft accommodation space 12*j* so as to extend along the outer periphery of the first shaft seal device 30 and the outer periphery of the second shaft seal device 32 in the periphery direction thereof and to be connected to both of the communication portion 30*a* of the first shaft seal device 30 and the communication portions 32*c* of the second shaft seal device 32.

In this embodiment, as illustrated in FIG. 2, the connection space 12*n* of the atmosphere communication portion 12*m* of the casing 12 connected to the communication portion 30*a* of the first shaft seal device 30 and the communication portions 32*c* of the second shaft seal device 32 (hatched portions) fitted on the male screw rotor 14 is integrated with the connection space 12*n* of the atmosphere communication portion 12*m* of the casing 12 connected to the communication portion 30*a* of the first shaft seal device 30 and the communication portions 32*c* of the second shaft seal device 32 (hatched portions) fitted on the female screw rotor 16, thereby forming one sharing space 12*r*. Specifically, the male screw rotor 14 and the female screw rotor 16 are disposed in the casing 12 so that rotation center lines C thereof are aligned diagonally with respect to the horizontal direction (X-Y plane). The connection space 12*n* of the male screw rotor 14 is diagonally coupled to the connection space 12*n* of the female screw rotor 16, thereby forming the one sharing space 12*r*.

In this embodiment, the external communication portion 12*p* of the atmosphere communication portion 12*m* of the casing 12 is a through hole, and although the detail thereof will be described later, the external communication portion 12*p* mainly discharges, to the outside of the casing 12, compressed air that has passed through the communication portion 30*a* of the first shaft seal device 30 and has then flown into the connection space 12*n* (sharing space 12*r*).

In this embodiment, the external communication portion 12*q* of the atmosphere communication portion 12*m* of the casing 12 is a through hole, and although the detail thereof will be described later, the external communication portion 12*q* mainly discharges, to the outside of the casing 12, compressed air that has passed through the communication portion 30*a* of the first shaft seal device 30 and has then flown into the connection space 12*n* (sharing space 12*r*). In addition, the external communication portion 12*q* discharges, to the outside of the casing 12, lubricating oil that has passed through the communication portions 32*c* when the seal 32*a* of the second shaft seal device 32 is damaged due to foreign substance biting and others, and has then flown into the connection space 12*n* (sharing space 12*r*). For that, the external communication portion 12*q* extends diagonally downward from the lower portion of the connection space 12*n* (sharing space 12*r*).

With such a configuration, compressed air in the rotor chamber 12*a* that has passed through between the two seal rings 36 and 38 (seals 36*a* and 38*a*) of the first shaft seal device 30 and the shaft 14*c* of the male screw rotor 14 mainly flows via the communication portion 30*a* of the first shaft seal device 30 into the connection space 12*n* (sharing space 12*r*) of the atmosphere communication portion 12*m* of the casing 12. Then, the compressed air that has flown into the connection space 12*n* is discharged via the external communication portions 12*p* and 12*q* to the outside of the casing 12. This further prevents passing of compressed air through between the second shaft seal device 32 and the shaft 14*c* of the screw rotor 14 for flowing to the bearing 26 side and the bearing 28 side.

In addition, lubricating oil that has passed through the seal 32*a* when the seal 32*a* of the second shaft seal device 32 is damaged flows into the annular groove 32*d*. The lubricating oil in the annular groove 32*d* of the second shaft seal device 32 flows via the plurality of communication portions 32*c* into the connection space 12*n* (sharing space 12*r*) of the atmosphere communication portion 12*m* of the casing 12. Then, the lubricating oil that has flown into the connection space 12*n* is discharged via the external communication portion 12*q* on the lower side to the outside of the casing 12. This prevents passing of lubricating oil through between the first shaft seal device 30 and the shaft 14*b* of the screw rotor 14 and through between the first shaft seal device 30 and the shaft 14*c* of the screw rotor 14 for intrusion into the rotor chamber 12*a*.

Lubricating oil that has flown into the connection space 12*n* (sharing space 12*r*) of the atmosphere communication portion 12*m* of the casing 12 is collected into an oil collection portion 12*s* in the lower portion in the connection space 12*n* (sharing space 12*r*) by its own weight with time, and is then discharged from the oil collection portion 12*s* via the external communication portion 12*q* extending diagonally downward to the outside of the casing 12. This can prevent intrusion of the lubricating oil into the rotor chamber 12*a* without immersing the shafts 14*b* and 14*c* of the male screw rotor in the lubricating oil collected in the connection space 12*n*.

In addition, as illustrated in FIG. 2, the angular position of the communication portion 30*a* of the first shaft seal device 30 with respect to rotation center line C of the male screw rotor 14 is preferably different from the angular positions of the communication portions 32*c* of the second shaft seal device 32 with respect to rotation center line C of the male screw rotor 14. In particular, the communication portion 30*a* of the first shaft seal device 30 is preferably provided so as to be higher than the communication portions 32*c* of the second shaft seal device 32.

Unlike this, when the angular position of the communication portion 30*a* of the first shaft seal device 30 and the angular positions of the communication portions 32*c* of the second shaft seal device 32 are the same, that is, when these overlap with each other when seen in the extension direction of rotation center line C of the male screw rotor 14, there is a possibility that lubricating oil that has passed through between the second shaft seal device 32 and the shaft 14*c* intrudes into between the first shaft seal device 30 and the shaft 14*c*.

Specifically, lubricating oil that has passed through the seal 32*a* when the seal 32*a* of the second shaft seal device 32 is damaged flows via the communication portions 32*c* into the connection space 12*n* (sharing space 12*r*). During the load operation, the lubricating oil that has flown into the connection space 12*n* is discharged via the atmosphere communication portion 12*q* to the outside of the casing. By a negative pressure that has generated in the rotor chamber 12*a* after the start of the unload operation of the screw compressor 10, the atmosphere that has flown from the outside of the casing into the connection space 12*n* (sharing space 12*r*) flows via the communication portion 30*a* of the first shaft seal device 30 to the rotor chamber 12*a* side.

When the communication portion 30*a* of the first shaft seal device 30 and the communication portions 32*c* of the second shaft seal device 32 are close to each other at this time, lubricating oil that has just flown into the connection space 12*n* is drawn toward flow of the atmosphere flowing via the communication portion 30*a* of the first shaft seal device 30 to the rotor chamber 12*a* side so that the lubricating oil intrudes into between the first shaft seal device 30 and the shaft 14*c*. As a result, there is a possibility that the lubricating oil intrudes into the rotor chamber 12*a*.

To prevent intrusion of the lubricating oil into the rotor chamber 12*a* in this state, the angular position of the communication portion 30*a* of the first shaft seal device 30 with respect to rotation center line C of the male screw rotor 14 (each of the shafts 14*b* and 14*c*) is different from the angular positions of the communication portions 32*c* of the second shaft seal device 32 with respect to rotation center line C of the male screw rotor 14 (each of the shafts 14*b* and 14*c*), so that the communication portion 30*a* of the first shaft seal device 30 is separated from the communication portions 32*c* of the second shaft seal device 32.

In particular, when the communication portion 30*a* of the first shaft seal device 30 is higher than the communication portions 32*c* of the second shaft seal device 32, this can prevent drawing of lubricating oil toward flow of the atmosphere flowing from the connection space 12*n* (sharing space 12*r*) into the communication portion 30*a* by the own weight of the lubricating oil. As compared with a case that the communication portion 30*a* of the first shaft seal device 30 is lower than the communication portions 32*c* of the second shaft seal device 32, the possibility of flow of the lubricating oil into the rotor chamber 12*a* is low.

Further, as illustrated in FIG. 3, the flow passage sectional area of the communication portion 30*a* of the first shaft seal device 30 is preferably larger than the flow passage sectional area between a portion 32*e* (hereinafter, referred to as a "contraction flow portion"), which is provided on the bearing side with respect to the communication portion 30*a* and on the screw 14*a* side with respect to the communication portions 32*c* of the second shaft seal device 32 and sectioning the space in which the communication portions communicate with each other, and the shaft 14*c*. That is, the flow passage sectional area of the communication portion 30*a* of the first shaft seal device 30 is preferably larger than the flow passage sectional area between the contraction flow portion 32*e* and the shaft 14*c*. In particular, the flow passage sectional area of the communication portion 30*a* of the first shaft seal device 30 is preferably sufficiently larger than the flow passage sectional area between the contraction flow portion 32*e* and the shaft 14*c*.

Specifically, in this embodiment, as illustrated in FIG. 5, as illustrated in FIG. 3, the flow passage sectional area of the communication portion 30*a* of the first shaft seal device 30 in a slot shape is sufficiently larger than the flow passage sectional area between the portion (the contraction flow portion) 32*e* of the second shaft seal device 32 on the screw 14*a* side of the male screw rotor 14 with respect to the annular groove 32*d* and the shaft 14*c*. Its reason will be described.

If the flow passage sectional area of the communication portion 30*a* of the first shaft seal device 30 is smaller than the flow passage sectional area between the contraction flow portion 32*e* of the second shaft seal device 32 and the shaft 14*c* of the male screw rotor 14, the atmosphere that flows from the outside of the casing during the unload operation passes via the communication portions 32*c* of the second shaft seal device 32, not via the communication portion 30*a* of the first shaft seal device 30, through between the contraction flow portion 32*e* and the shaft 14*c* of the male screw rotor 14. As a result, a negative pressure is generated in the seal 32*a* of the second shaft seal device 32, so that there is a possibility that lubricating oil intrudes into the rotor chamber 12*a*.

To prevent intrusion of the lubricating oil into the rotor chamber 12*a* in this state, the flow passage sectional area of the communication portion 30*a* of the first shaft seal device 30 is sufficiently larger than the flow passage sectional area between the contraction flow portion 32*e* of the second shaft seal device 32 and the shaft 14*c* of the male screw rotor 14. This passes the atmosphere flowing from the outside of the casing through the communication portion 30*a* of the first shaft seal device 30 having a relatively large flow passage sectional area, and then flows the atmosphere into the rotor chamber 12*a*. This can prevent passing of the atmosphere flowing from the outside of the casing through between the contraction flow portion 32*e* of the second shaft seal device 32 having a relatively small flow passage sectional area and the male screw rotor 14. As a result, the lubricating oil can be prevented from intruding into the rotor chamber 12*a*.

In addition, the positions of the plurality of communication portions 32*c* of the second shaft seal device 32 are preferably different in the periphery direction when seen in the extension direction (X-axis direction) of rotation center line C of the male screw rotor 14 (each of the shafts 14*b* and 14*c*). As illustrated in FIG. 2, more preferably, the angular positions of the plurality of communication portions 32*c* of the second shaft seal device 32 with respect to rotation center line C of the male screw rotor 14 (each of the shafts 14*b* and 14*c*) are different.

In this embodiment, as illustrated in FIG. 2, the plurality of communication portions 32*c* of the second shaft seal device 32 are divided into two groups G1 and G2. The positions of the communication portions 32*c* belonging to the second group G2 are different in the periphery direction from the positions of the communication portions 32*c* belonging to the first group G1. In addition, the communication portions 32*c* belonging to the second group G2 are disposed so as to be lower than the communication portions 32*c* belonging to the first group G1. For that, lubricating oil that has passed through the seal 32*a* when the seal 32*a* of the second shaft seal device 32 is damaged passes through the communication portions 32*c* belonging to the second group G2, and then flows into the connection space 12*n* (sharing space 12*r*) of the atmosphere communication portion 12*m* of the casing 12.

At this time, the communication portions 32*c* belonging to the first group G1 serves to communicate the portion between the second shaft seal device 32 and the shaft 14*c* of the male screw rotor 14 (in this embodiment, the interior of the annular groove 32*d*) with the atmosphere via the atmosphere communication portion 12*m* of the casing 12. That is, the lubricating oil can be pushingly flown to the communication portions 32*c* belonging to the second group G2 by the atmosphere (atmospheric pressure) introduced via the communication portions 32*c* belonging to the group G1. As a result, the lubricating oil between the second shaft seal device 32 and the male screw rotor 14 (in this embodiment, the lubricating oil in the interior of the annular groove 32*d*) can smoothly flow into the atmosphere communication portion 12*m* of the casing 12 via the communication portions 32*c* belonging to the second group G2.

The screw compressor 10 in which the angular positions of the plurality of communication portions 32*c* of the second shaft seal device 32 with respect to rotation center line C of the screw rotor 14 are different includes high general-purpose properties as a secondary effect.

The screw compressor 10 illustrated in FIG. 2 is disposed so that the suction port 12*c* directs in the up direction (Z-axis positive direction) and that the discharge port 12*e* directs in the horizontal direction (Y-axis negative direction). In this state, among the plurality of communication portions 32*c* of the second shaft seal device 32, the communication portions 32*c* belonging to the first group G1 are located upwardly of the communication portions 32*c* belonging to the second group G2. Thus, as described above, the communication portions 32*c* belonging to the second group G2 serve to flow lubricating oil that has passed through the seal 32*a* when the seal 32*a* of the second shaft seal device 32 is damaged, into the atmosphere communication portion 12*m* of the casing 12. The communication portions 32*c* belonging to the first group G1 serve to communicate the portion between the second shaft seal device 32 and the male screw rotor 14 (in this embodiment, the interior of the annular groove 32*d*) with the atmosphere via the atmosphere communication portion 12*m* of the casing 12.

Figure 6:
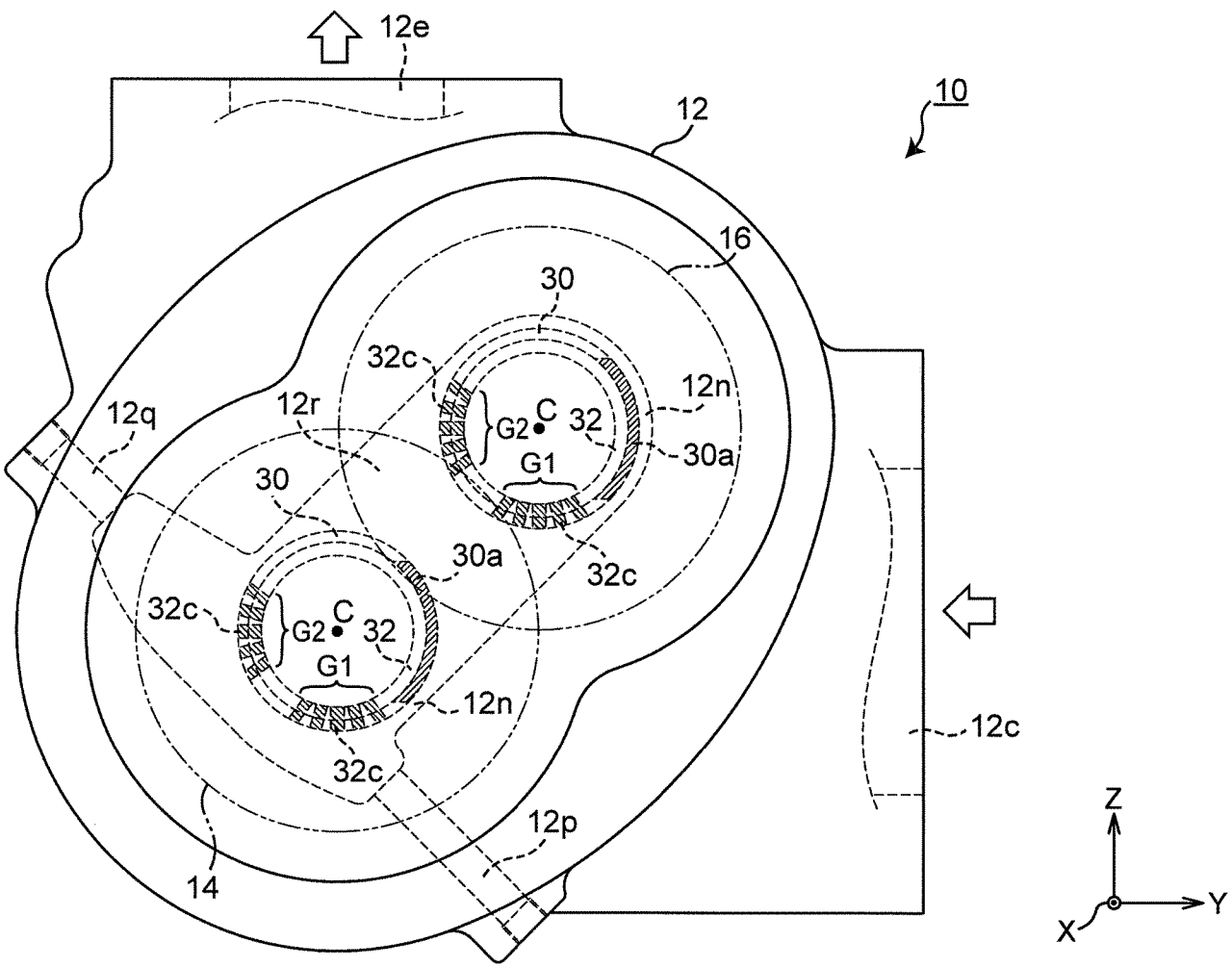
FIG. 6 is a schematic front view illustrating a state where the oil-free screw compressor in FIG. 2 is posture-changed.

FIG. 6 illustrates a state where the screw compressor 10 in FIG. 2 is posture-changed. The posture of the screw compressor 10 illustrated in FIG. 6 is the posture of the screw compressor 10 that has been rotated 90 degrees about the rotation center line extending in parallel with rotation center line C of the male screw rotor 14, from the posture illustrated in FIG. 2 (in the drawing, the posture in which the screw compressor 10 is rotated clockwise about the X-axis).

When the screw compressor 10 takes the posture illustrated in FIG. 6, the suction port 12*c* directs in the horizontal direction (Y-axis positive direction), and the discharge port 12*e* directs in the up direction (Z-axis positive direction). In this state, among the plurality of communication portions 32*c* of the second shaft seal device 32, the communication portions 32*c* belonging to the second group G2 are located upwardly of the communication portions 32*c* belonging to the first group G1. Thus, the communication portions 32*c* belonging to the first group G1 serve to flow lubricating oil that has passed through the seal 32*a* when the seal 32*a* of the second shaft seal device 32 is damaged, into the atmosphere communication portion 12*m* of the casing 12. The communication portions 32*c* belonging to the second group G2 serve to communicate the portion between the second shaft seal device 32 and the male screw rotor 14 (in this embodiment, the interior of the annular groove 32*d*) with the atmosphere via the atmosphere communication portion 12*m* of the casing 12. In addition, since the communication portion 30*a* is located upwardly of the communication portions 32*c* belonging to the first group G1, it is possible to prevent drawing of lubricating oil that has flown from the communication portions 32*c* belonging to the first group G1 into the atmosphere communication portion 12*m* of the casing 12 toward flow of the atmosphere flowing into the communication portion 30*a*.

By changing the roles of the communication portions 32*c* belonging to the first group G1 and the second group G2 of the second shaft seal device 32 in this manner, the screw compressor 10 can be posture-changed without re-assembling by replacing the shaft seal device or by changing the angular position of the shaft seal device. This allows the screw compressor 10 to include high general-purpose properties.

As illustrated in FIGS. 2 and 6, after the screw compressor 10 is posture-changed, the first shaft seal device 30 fitted on each of the male screw rotor 14 and the female screw rotor 16 may be rotated about rotation center line C of each of the screw rotors 14 and 16 by e.g., a manual operation by the operator so that the communication portion 30*a* directs in the up direction.

Figure 7:
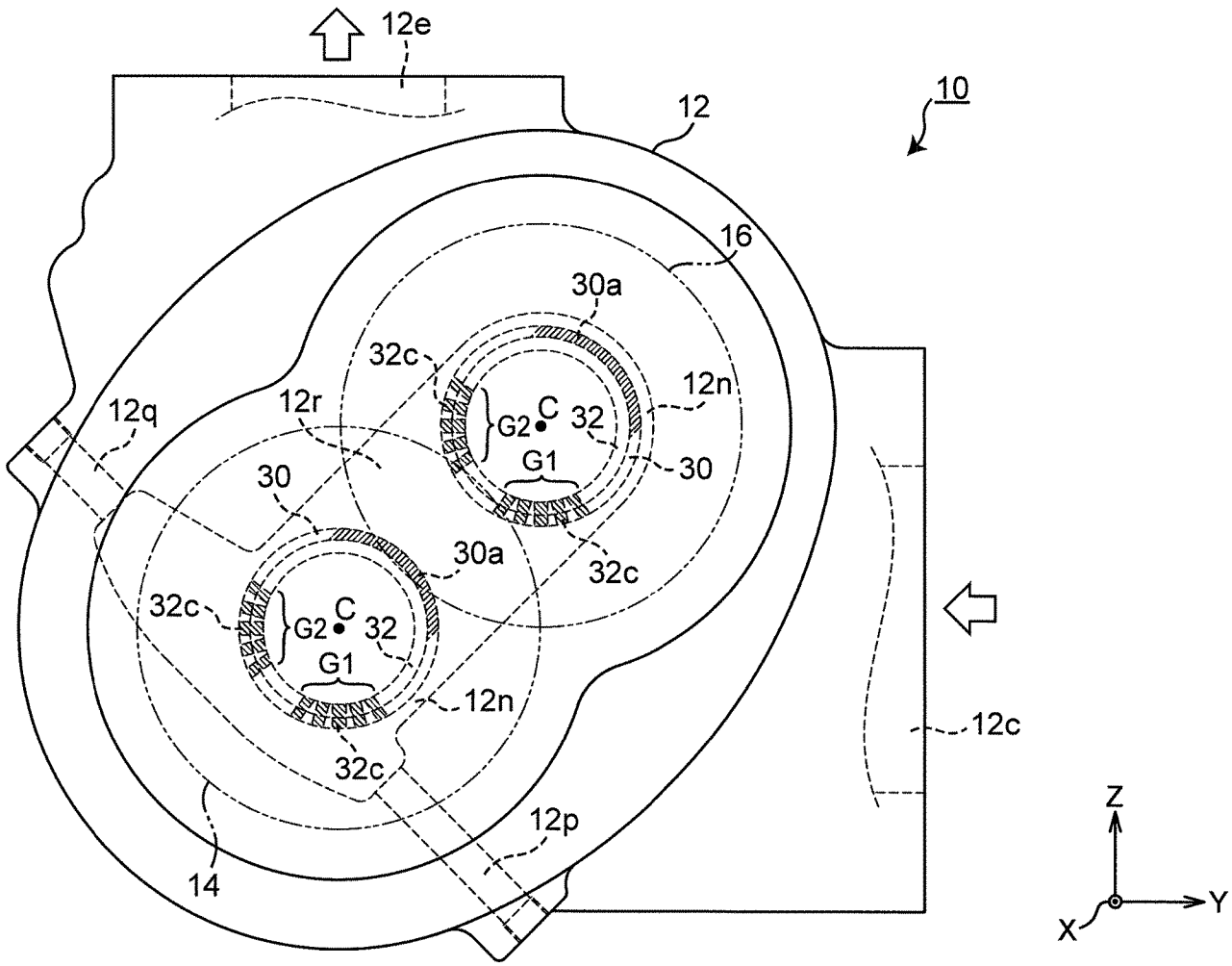
FIG. 7 is a schematic front view of the oil-free screw compressor in which the relative position of the communication portion of the first shaft seal device with respect to the communication portion of the second shaft seal device is different with respect to the oil-free screw compressor illustrated in FIGS. 2 and 6.

Alternatively, as illustrated in FIG. 7, the first shaft seal device 30 of each of the two screw rotors 14 and 16 may be fitted on each of the screw rotors 14 and 16 so that the communication portion 30*a* is opposite to between the communication portions 32*c* belonging to the first group G1 and the communication portions 32*c* belonging to the second group G2 of the second shaft seal device 32 across rotation center line C when seen in the extension direction (X-axis direction) of rotation center line C. This can omit the manual operation by the operator who rotates the first shaft seal device 30 after the screw compressor 10 is posture-changed. Further, the position relation between the communication portion 30*a* and the communication portions 32*c* serving to flow lubricating oil into the atmosphere communication portion 12*m* of the casing 12 (the communication portions belonging to the first group G1 or the second group G2) can have the same conditions even when the screw compressor 10 is posture-changed.

According to this embodiment, it is possible to provide the screw compressor 10 that can ensure sealability of the first shaft seal device 30 and the second shaft seal device 32 with respect to each of the male screw rotor 14 and the female screw rotor 16, is easy to manufacture, and can prevent bending of the male screw rotor 14 and the female screw rotor 16.

Specifically, as illustrated in FIG. 3, both of the communication portion 30*a* of the first shaft seal device 30 and the communication portions 32*c* of the second shaft seal device 32 communicate with the atmosphere outside of the casing 12 via one atmosphere communication portion 12*m* formed in the casing 12. This can easily manufacture the casing 12 as compared with a case that the atmosphere communication portions with respect to the communication portion 30*a* of the first shaft seal device 30 and the communication portions 32*c* of the second shaft seal device 32 are formed in the casing 12 (as compared with a case that two individual atmosphere communication portions are provided).

In addition, as compared a case that the atmosphere communication portions with respect to the communication portion 30*a* of the first shaft seal device 30 and the communication portions 32*c* of the second shaft seal device 32 are formed in the casing 12, the distance between the screw 14*a* of the male screw rotor 14 and each of the bearings 24 and 26 (in other words, the distance between the two bearings 24 and 26) can be short. As a result, bending of the male screw rotor 14 can be prevented (likewise, bending of the female screw rotor 16 can be prevented).

This will be specifically described. When two atmosphere communication portions with respect to the communication portion 30*a* of the first shaft seal device 30 and the communication portions 32*c* of the second shaft seal device 32 are formed in the casing, the atmosphere communication portions are formed in the casing 12 so as not to interfere with each other by making their positions in the extension direction (X-axis direction) in the direction of rotation center line C of each of the screw rotors 14 and 16 different. This limits disposition of the communication portion 30*a* of the first shaft seal device 30 and the communication portions 32*c* of the second shaft seal device 32, which communicate with the atmosphere communication portions, in such a manner that the communication portion 30*a* and the communication portions 32*c* are close to each other in the extension direction of rotation center line C of each of the screw rotors 14 and 16. That is, the distance in the extension direction of rotation center line C between the communication portion 30*a* of the first shaft seal device 30 and the communication portions 32*c* of the second shaft seal device 32 inevitably becomes long. With this, the distance between the screw of each of the screw rotors 14 and 16 and each of the bearings 24 and 26 (that is, the distance between the two bearings 24 and 26) inevitably becomes long. As a result, the screw rotors 14 and 16 are likely to bend.

Thus, both of the communication portion 30*a* of the first shaft seal device 30 and the communication portions 32*c* of the second shaft seal device 32 communicate with one atmosphere communication portion 12*m* formed in the casing 12, so that the distance between the communication portion 30*a* of the first shaft seal device 30 and the communication portions 32*c* of the second shaft seal device 32 can be short.

In addition, in this embodiment, as illustrated in FIG. 5, the first shaft seal device 30 and the second shaft seal device 32 engage with each other so as to partially overlap with each other when seen in the diameter direction of the male screw rotor 14. This can make the distance between the communication portion 30*a* of the first shaft seal device 30 and the communication portions 32*c* of the second shaft seal device 32 shorter. Here, the first shaft seal device 30 and the second shaft seal device 32 engage with each other so as to overlap with each other, so that the slot-shaped through hole is formed by the cutaway portion 34*b* formed in the end face of the main body 34 on the bearing 26 side (on the second shaft seal device 32 side). This can make the distance between the communication portion 30*a* of the first shaft seal device 30 and the communication portions 32*c* of the second shaft seal device 32 much shorter.

While the distance between the communication portion 30*a* of the first shaft seal device 30 and the communication portions 32*c* of the second shaft seal device 32 can be short, the distance between the screw 14*a* of the male screw rotor 14 and the bearing 26 (likewise, the distance between the screw 14*a* and the bearing 24) can also be short. That is, the distance between the bearings 24 and 26 opposite to each other across the screw 14*a* can be short. As a result, bending of the male screw rotor 14 can be prevented (likewise, bending of the female screw rotor 16 can be prevented).

The present invention has been described above by giving the above embodiment, but is not limited to this.

For instance, in the above embodiment, as illustrated in FIG. 3, the first shaft seal device 30 includes the main body 34 and the two seal rings 36 and 38, but the embodiment of the present invention is not limited to this. For instance, the number of seal rings is not limited to two, and like the second shaft seal device 32, the first shaft seal device may include one member.

In the above embodiment, as illustrated in FIG. 3, the second shaft seal device 32 includes one member, but the embodiment of the present invention is not limited to this. For instance, like the first shaft seal device 30, the second shaft seal device may include a plurality of members.

In the above embodiment, as illustrated in FIG. 5, the communication portion 30*a* of the first shaft seal device 30 is one slot-shaped through hole (cutaway portion 34*b*), and the communication portions 32*c* of the second shaft seal device 32 are a plurality of through holes, but the embodiment of the present invention is not limited to this. The shape and number of communication portions of the first shaft seal device and the second shaft seal device are not limited as long as the inner peripheral faces thereof and the outer peripheral faces thereof communicate with each other.

In the above embodiment, as illustrated in FIG. 2, the male screw rotor 14 and the female screw rotor 16 are accommodated in the casing 12 so as to be aligned diagonally with respect to the horizontal direction (X-Y plane), but the embodiment of the present invention is not limited to this.

Figure 8:
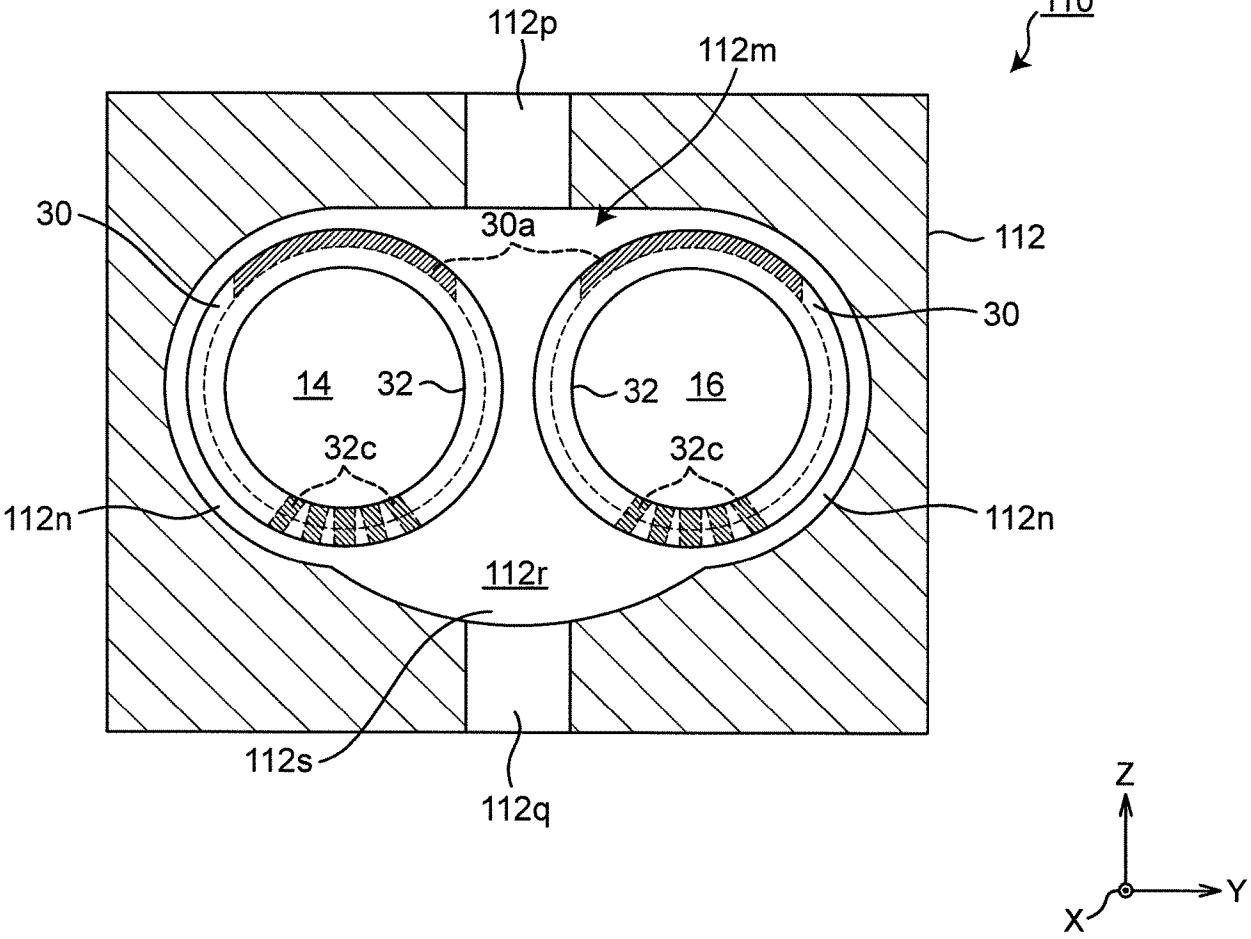
FIG. 8 is a cross-sectional view schematically illustrating the atmosphere communication portion of an oil-free screw compressor according to another embodiment of the present invention.

For instance, like a screw compressor 110 according to another embodiment schematically illustrated in FIG. 8, the male screw rotor 14 and the female screw rotor 16 may be accommodated in the casing 112 so as to be aligned in the horizontal direction (Y-axis direction).

In the embodiment illustrated in FIG. 8, a connection space 112*n* connected to the communication portion 30*a* of the first shaft seal device 30 and the communication portions 32*c* of the second shaft seal device 32 fitted on the male screw rotor 14 is coupled in the horizontal direction to the connection space 112*n* connected to the communication portion 30*a* of the first shaft seal device 30 and the communication portions 32*c* of the second shaft seal device 32 fitted on the female screw rotor 16, thereby forming a sharing space 112*r*.

An external communication portion 112*p* communicating upward from the upper portion of the sharing space 112*r* toward the outside of a casing 112 and an external communication portion 112*q* communicating downward from the lower portion of the sharing space 112*r* toward the outside of the casing 112 are formed in the casing 112. In addition, an oil collection portion 112*s* is provided between the connection spaces 112*n* (that is, the sharing space 112*r*) and the external communication portion 112*q* on the lower side.

In the above embodiment, the atmosphere communication portion 12*m* of the casing 12 includes the two external communication portions 12*p* and 12*q*, but the embodiment of the present invention is not limited to this.

Figure 9:
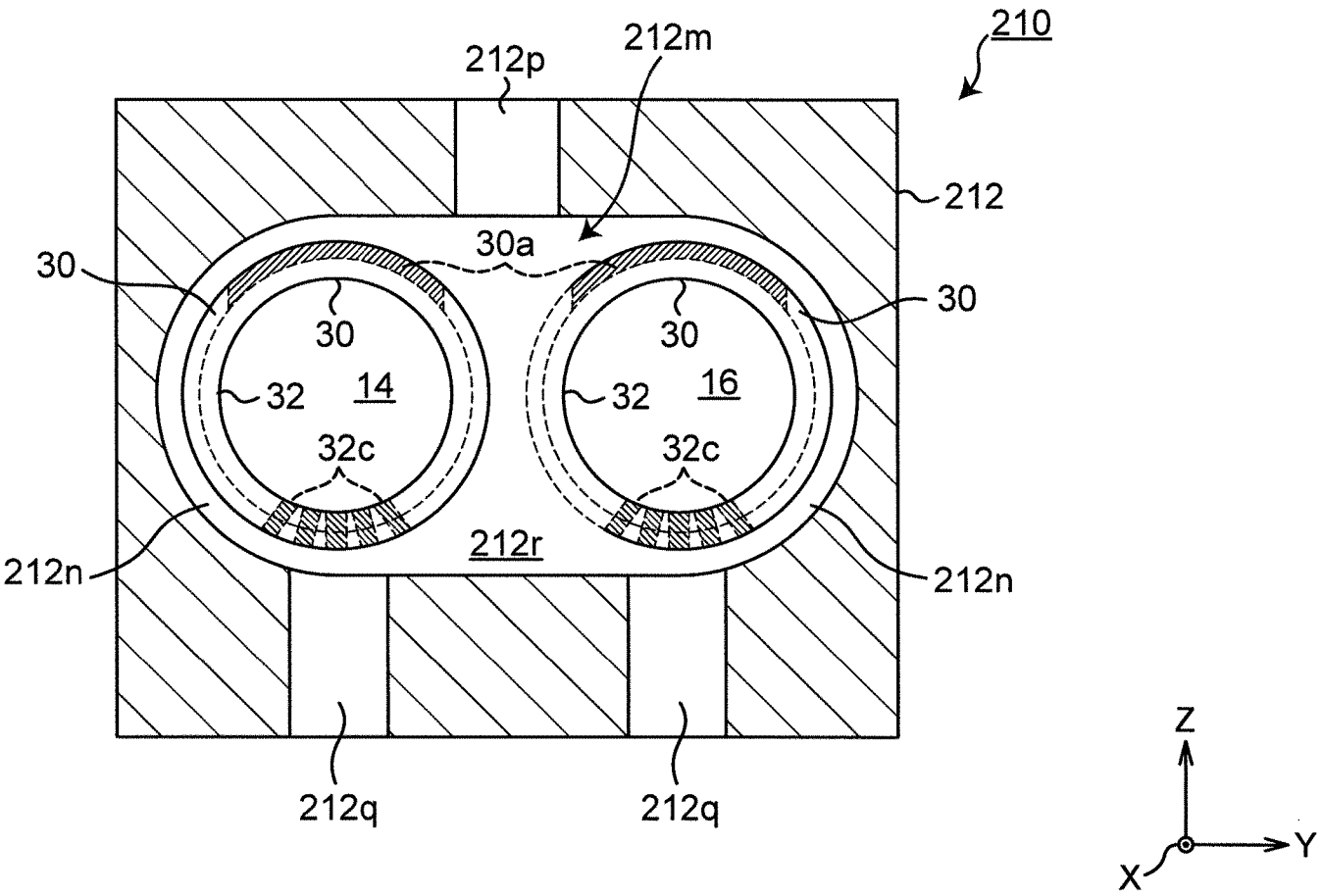
FIG. 9 is a cross-sectional view schematically illustrating the atmosphere communication portion of an oil-free screw compressor according to a further embodiment of the present invention.

For instance, like a screw compressor 210 according to a further embodiment schematically illustrated in FIG. 9, three external communication portions 212*p* and 212*q* may be formed in a casing 212.

As illustrated in FIG. 9, one external communication portion 212*p* communicates upward from the upper portion of connection spaces 212*n* (sharing space 212*r*) toward the outside of the casing 212, and two external communication portions 212*q* communicate downward from the lower portion of the connection spaces 212*n* (sharing space 212*r*) toward the outside of the casing 212. One of the external communication portions 212*q* is disposed below the communication portions 32*c* of the second shaft seal device 32 fitted on the male screw rotor 14. The other external communication portion 212*q* is disposed below the communication portions 32*c* of the second shaft seal device 32 fitted on the female screw rotor 16. Thus, lubricating oil that has passed through the communication portions 32*c* of the second shaft seal device 32 flows into the external communication portions 212*q* directly and smoothly, and is then discharged to the outside of the casing 212. As a result, the oil collection portion temporarily collecting the lubricating oil can be omitted.

In the above embodiment, as illustrated in FIG. 2, the atmosphere communication portion 12*m* of the casing 12 includes the external communication portion 12*p* extending in the up direction (diagonally upward), and the external communication portion 12*q* extending in the down direction (diagonally downward), but the extension directions of the external communication portions are not limited to these. The external communication portions may extend in the horizontal direction.

Figure 10:
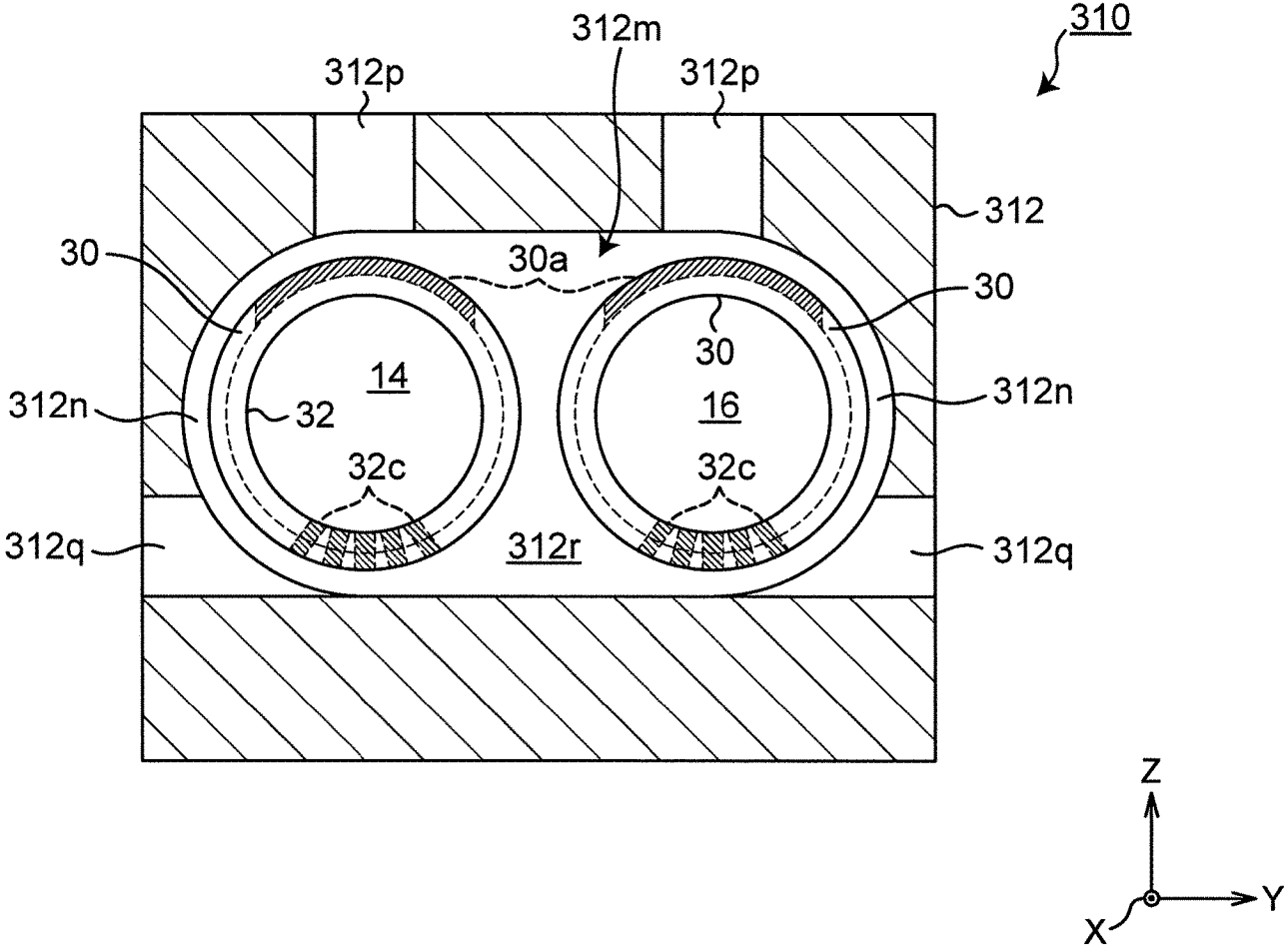
FIG. 10 is a cross-sectional view schematically illustrating the atmosphere communication portion of an oil-free screw compressor according to a different embodiment of the present invention.

For instance, like an oil-free screw compressor 310 according to a different embodiment schematically illustrated in FIG. 10, among a plurality of external communication portions 312*p* and 312*q*, the external communication portions 312*q* extend in the horizontal direction. In the embodiment illustrated in FIG. 10, the external communication portions 312*q* on the lower side, that is, the external communication portions 312*q* into which lubricating oil flows, extend in the horizontal direction. In this case, the bottom of a sharing space 312*r* of an atmosphere communication portion 312*m* may be formed so as to extend in the horizontal direction, and may be formed so as to incline downward with respect to the external communication portions 312*p*.

In the above embodiment, as illustrated in FIG. 2, the connection space 12*n* of the atmosphere communication portion 12*m* of the casing 12 connected to the communication portion 30*a* of the first shaft seal device 30 and the communication portions 32*c* of the second shaft seal device 32 fitted on the male screw rotor 14 is integrally coupled to the connection space 12*n* of the atmosphere communication portion 12*m* of the casing 12 connected to the communication portion 30*a* of the first shaft seal device 30 and the communication portions 32*c* of the second shaft seal device 32 fitted on the female screw rotor 16, thereby configuring the sharing space 12*r*, but the embodiment of the present invention is not limited to this. The connection space 12*n* of the male screw rotor 14 and the connection space 12*n* of the female screw rotor 16 may be formed in the casing 12 without being coupled.

For instance, in the above embodiment, the screw type visco seal having a screw groove pushingly returning oil to the bearing side is illustrated as the seal 32*a*, but the embodiment of the present invention is not limited to this. The seal may be a labyrinth seal when it is a non-contact seal, and may be a lip seal when it is a contact seal.

In the above embodiment, as illustrated in FIG. 2, the communication portion 30*a* of the first shaft seal device 30 and the communication portions 32*c* of the second shaft seal device 32 in the male screw rotor 14 and the communication portion 30*a* of the first shaft seal device 30 and the communication portions 32*c* of the second shaft seal device 32 in the female screw rotor 16 communicate with the sharing connection space 12*n*. The connection space 12*n* of the male screw rotor 14 and the connection space 12*n* of the female screw rotor 16 communicate with each other, thereby configuring the sharing space 12*r*. However, the embodiment of the present invention is not limited to this.

Figure 11:
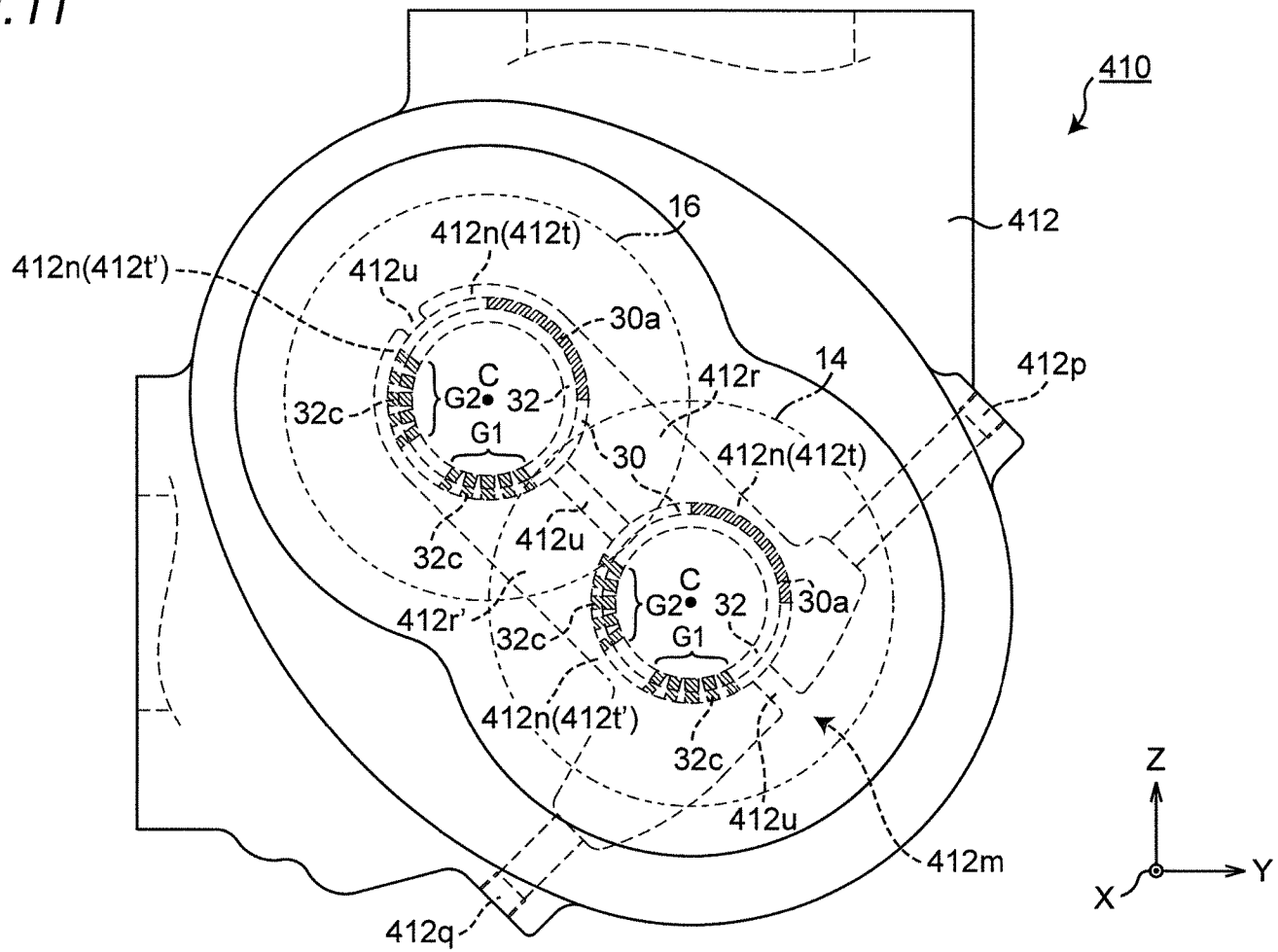
FIG. 11 is a schematic front view of an oil-free screw compressor according to a further different embodiment of the present invention.

For instance, FIG. 11 is a schematic front view of an oil-free screw compressor according to a further different embodiment of the present invention.

In an oil-free screw compressor 410 illustrated in FIG. 11, in each of the male screw rotor 14 and the female screw rotor 16, a connection space 412*n* is sectioned into a first sectioning region 412*t* and a second sectioning region 412*t*' by a partitioning wall 412*u*. The first sectioning region 412*t* and the second sectioning region 412*t*' are independent from each other, and do not communicate with each other. The first sectioning region 412*t* is located upwardly of the second sectioning region 412*t*'.

In addition, the first sectioning region 412*t* of the male screw rotor 14 communicates with the first sectioning region 412*t* of the female screw rotor 16, thereby configuring a sharing space 412*r*. Further, the second sectioning region 412*t*' of the male screw rotor 14 and the second sectioning region 412*t*' of the female screw rotor 16 communicate with each other, thereby configuring a sharing space 412*r*'.

The communication portions 30*a* of the first shaft seal device 30 of each of the male screw rotor 14 and the female screw rotor 16 communicates with the first sectioning region 412*t* of the connection space 412*n*, but does not communicate with the second sectioning region 412*t*'. On the other hand, the communication portions 32*c* of the second shaft seal device 32 of each of the male screw rotor 14 and the female screw rotor 16 do not communicate with the first sectioning region 412*t* of the connection space 412*n*, but communicate with the second sectioning region 412*t*'.

As illustrated in FIG. 11, the first sectioning region 412*t* of the connection space 412*n* communicates with the outside of a casing 412 via an external communication portion 412*p*. On the other hand, the second sectioning region 412*t*' communicates with the outside of the casing 412 via an external communication portion 412*q*.

The advantages of such a configuration will be described by taking the first shaft seal device 30 and the second shaft seal device 32 fitted on the shaft 14*c* of the male screw rotor 14, as an example.

When slight abnormality (a small damage in the seal 32*a*, and a small amount of leaked oil due to the increase in pressure in the space on the bearing side of the seal 32*a*) is caused in the seal between the second shaft seal device 32 and the shaft 14*c*, lubricating oil in the bearing 26 passes through the communication portions 32*c* of the second shaft seal device 32 to enter the second sectioning region 412*t*' of the connection space 412*n*, and then flows to the outside of the casing 412 via the external communication portion 412*q* communicating therewith.

On the other hand, when significant abnormality (a large amount of leaked oil due to a large damage in the seal) is caused in the seal between the second shaft seal device 32 and the shaft 14*c*, lubricating oil in the bearing 26 passes through the contraction flow portion 32*e* of the second shaft seal device 32 to enter the first sectioning region 412*t* of the connection space 412*n* via the communication portion 30*a* of the first shaft seal device 30 together with compressed air, and then flows to the outside of the casing 412 from the external communication portion 412*p* communicating therewith. In a state where the lubricating oil passes through the contraction flow portion 32*e*, the lubricating oil flows into the rotor chamber 12*a*.

Thus, by examining flow of the lubricating oil out of the external communication portions 412*p* and 412*q*, it is possible to identify the flow-out state of the lubricating oil due to the abnormality of the seal between the second shaft seal device 32 and the shaft 14*c* (whether the lubricating oil flows into the rotor chamber 12*a*), without disassembling the oil-free screw compressor 410.

The external communication portion 412*q* corresponding to the second sectioning region 412*t*' is located downwardly of the external communication portion 412*p* corresponding to the first sectioning region 412*t* communicating with the communication portion 30*a* of the first shaft seal device 30 so that the lubricating oil is smoothly discharged to the outside of the casing 412. That is, the lubricating oil that has leaked out from the seal of the second shaft seal device 32 is discharged to the outside via the second sectioning region 412*t*' and the external communication portion 412*q* relatively on the lower side.

Figure 12:
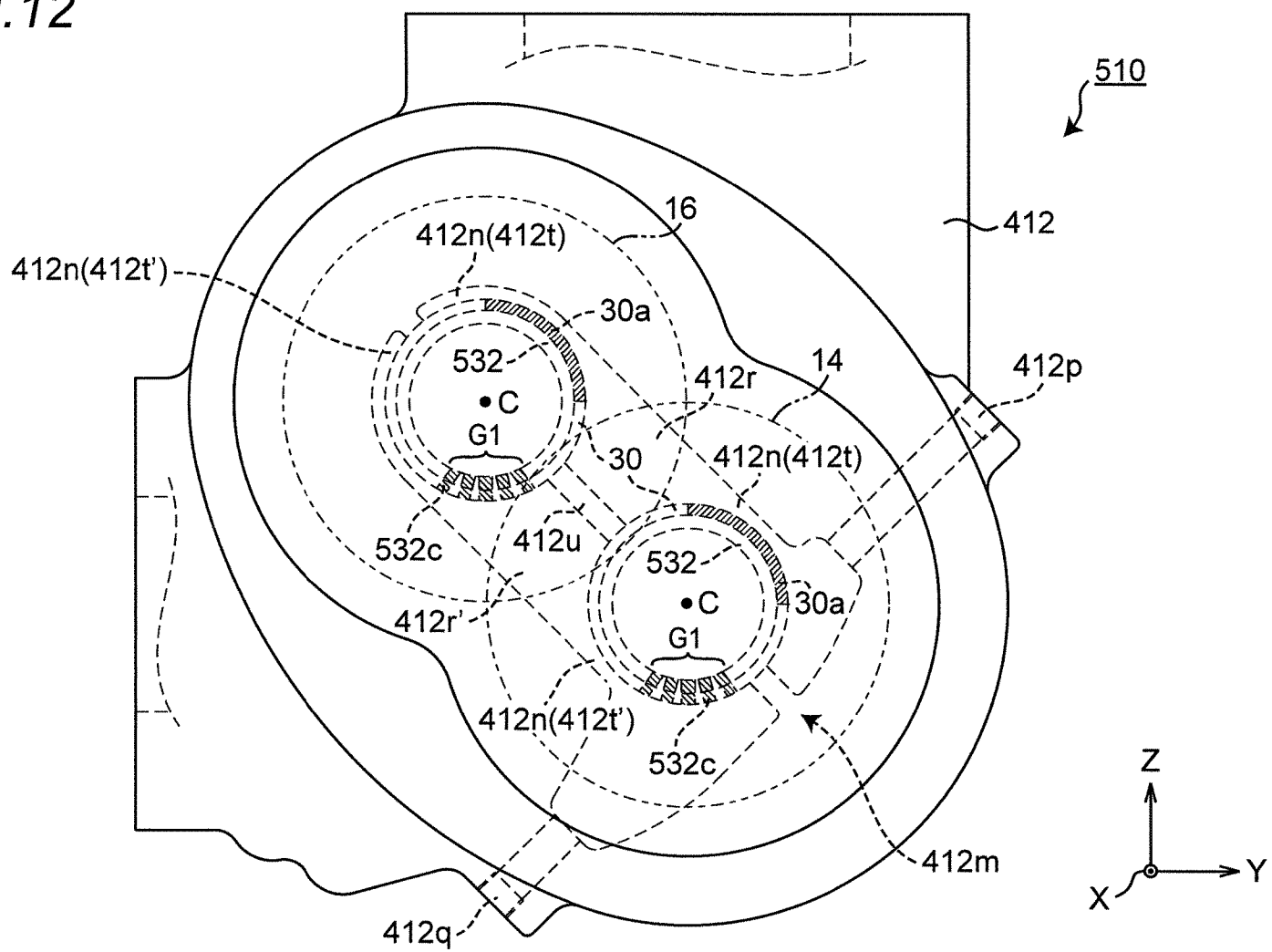
FIG. 12 is a schematic front view of an oil-free screw compressor according to a modification of the embodiment illustrated in FIG. 11.

As illustrated in FIG. 11, the plurality of communication portions 32*c* of the second shaft seal device 32 communicating with the second sectioning region 412*t*' of the connection space 412*n* are divided into the group G1 opened in the vertical direction (Z-axis direction) and the group G2 opened in the horizontal direction (Y-axis direction). However, the embodiment of the present invention is not limited to this. In place of this, an oil-free screw compressor 510 in a modification illustrated in FIG. 12 does not have the group opened in the horizontal direction (Y-axis direction) to which a plurality of communication portions 532*c* of a second shaft seal device 532 belong, but has only the group G1 opened in the vertical direction (Z-axis direction) to which the plurality of communication portions 532*c* of the second shaft seal device 532 belong. In this case, the processing cost for manufacturing the plurality of communication portions in the second shaft seal device can be low.

Figure 13:
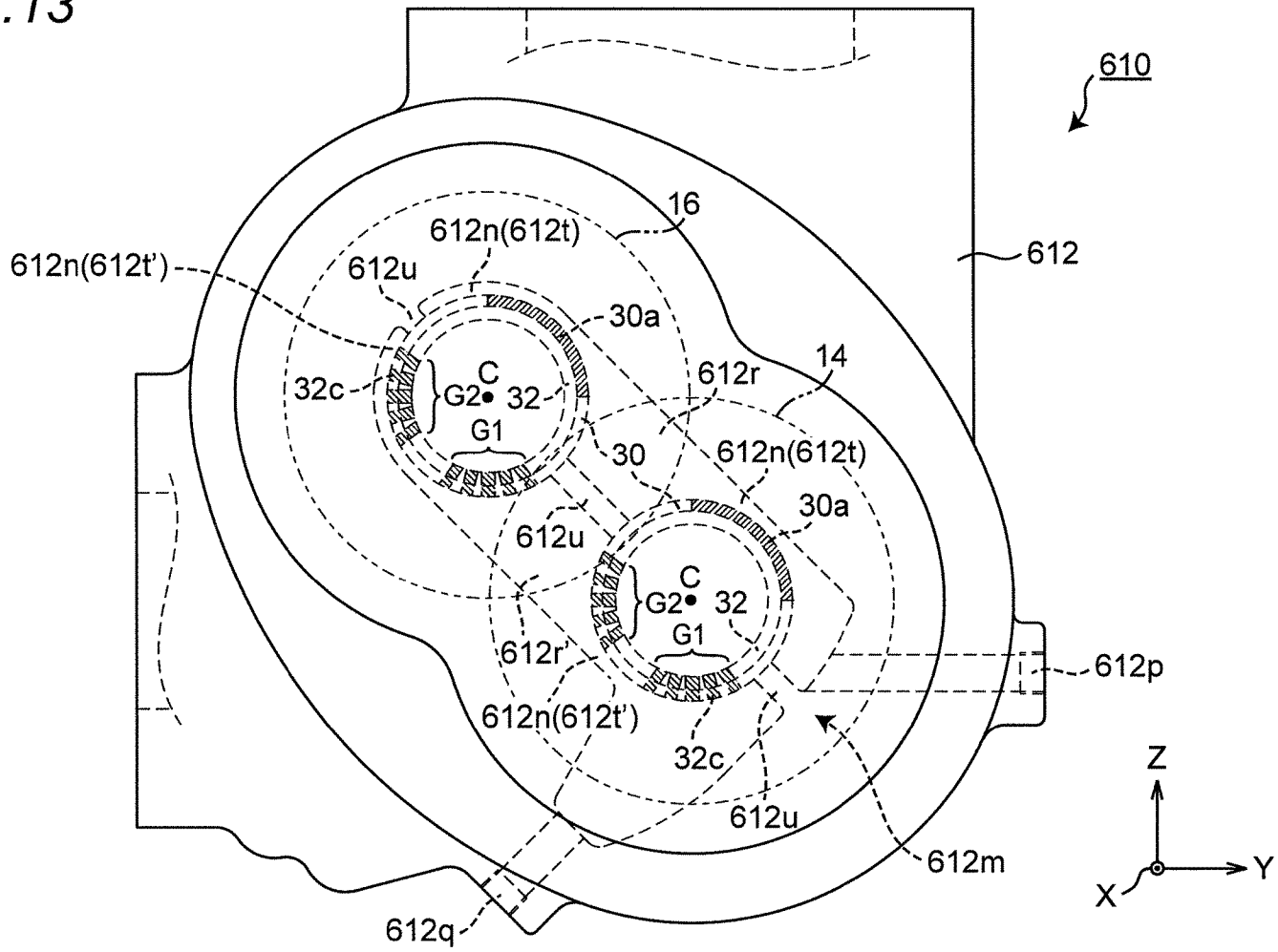
FIG. 13 is a schematic front view of an oil-free screw compressor according to another modification of the embodiment illustrated in FIG. 11.

As illustrated in FIG. 11, the external communication portion 412*p* communicating with the first sectioning region 412*t* of the connection space 412*n* extends diagonally upward from the first sectioning region 412*t* to communicate with the outside of the casing 412. However, the embodiment of the present invention is not limited to this. In place of this, in an oil-free screw compressor 610 in another modification illustrated in FIG. 13, an external communication portion 612*p* communicating with a first sectioning region 612*t* of a connection space 612*n* extends from the lower portion of the first sectioning region 612*t* (sharing space 612*r*) in the horizontal direction (Y-axis direction) to communicate with the outside of a casing 612. In this case, since lubricating oil in the bearing 26 that has flown into the first sectioning region 612*t* can be discharged to the outside of the casing 612 via the external communication portion 612*p* at the bottom of the first sectioning region 612*t*, the lubricating oil is hard to be collected in the first sectioning region 612*t*.

Figure 14:
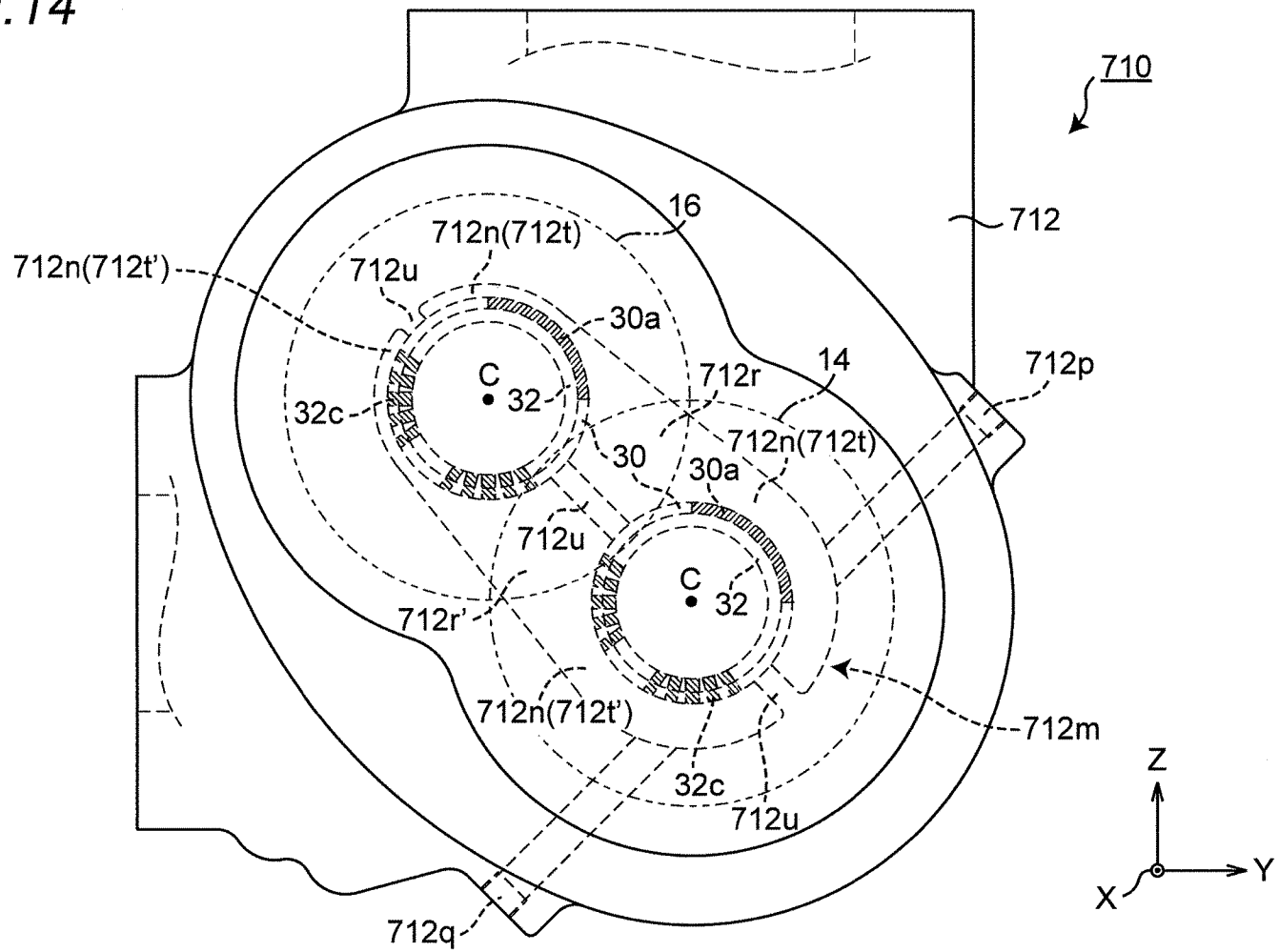
FIG. 14 is a schematic front view of an oil-free screw compressor according to a different modification of the embodiment illustrated in FIG. 11.

As illustrated in FIG. 11, the shapes of the first sectioning region 412*t* and the second sectioning region 412*t*' of the connection space 412*n* are not symmetric with respect to the partitioning wall 412*u* therebetween, and are different. However, the embodiment of the present invention is not limited to this. In place of this, in an oil-free screw compressor 710 in a modification illustrated in FIG. 14, a first sectioning region 712*t* and a second sectioning region 712*t*' are symmetric with respect to a partitioning wall 712*u* therebetween. In this case, the process for working the first sectioning region 712*t* and the second sectioning region 712*t*' in a casing 712 is simplified, thereby improving the productivity of the casing 712. In addition, the more closer the inner walls of the first and second sectioning regions 712$t$ and 712$t'$ are to the external communication portions 712$p$ and 712$q$, respectively, the more away the inner walls may be from the shaft seal devices by degrees. This can make flow of air smooth as compared with a case that the positions of the inner walls are not changed.

As illustration of the technique in this disclosure, various embodiments have been described above. For that, the accompanying drawings and the detailed description have been provided.

Thus, the components described in the accompanying drawings and the detailed description can include, not only the components essential for solving the problems, but also the components not essential for solving the problems, in order to illustrate the above technique. Thus, it should not be immediately identified that those non-essential components are essential since the non-essential components have been described in the accompanying drawings and the detailed description.

This disclosure has been sufficiently described in connection with the preferred embodiments with reference to the accompanying drawings, but various modifications and corrections are apparent for those skilled in the art. It should be understood that as long as such modifications and corrections do not depart from the scope of the present invention by the attached claims, they are included therein.

Finally, the present invention is applicable to a multi-stage oil-free screw compressor.

The invention claimed is:

1. An oil-free screw compressor comprising:

a screw rotor including a screw and a shaft;

a bearing supporting the shaft;

a first shaft seal device fitted on the shaft, disposed between the screw and the bearing, and including a first seal opposite to the shaft, and a first communication portion communicating between a portion of an inner periphery face of the first shaft seal device and the outer peripheral face of the first shaft seal device on a bearing side of the first seal;

a second shaft seal device fitted on the shaft, disposed between the first shaft seal device and the bearing, and including a second seal opposite to the shaft, and a second communication portion communicating between a portion of an inner periphery face of the second shaft seal device and the outer peripheral face of the second shaft seal device on a screw side of the second seal; and a casing including a rotor chamber accommodating the screw, and a shaft accommodation space accommodating the shaft, the bearing, the first shaft seal device, and the second shaft seal device, wherein the casing includes an atmosphere communication portion connected to both of the first communication portion and the second communication portion on the inner peripheral face of the shaft accommodation space, and communicating the first communication portion and the second communication portion with an atmosphere.

2. The oil-free screw compressor according to claim 1, wherein the angular position of the first communication portion with respect to the rotation center of the shaft is different from the angular position of the second communication portion with respect to the rotation center of the shaft, and wherein the atmosphere communication portion includes a connection space formed in a recess shape in the inner peripheral face of the shaft accommodation space so that the connection space is connected to both of the first communication portion and the second communication portion in which the angular positions are different from each other.

3. The oil-free screw compressor according to claim 2, wherein the atmosphere communication portion includes an external communication portion communicating the lower portion of the connection space with the atmosphere outside of the casing, and an oil collection portion provided between the external communication portion and the connection space.

4. The oil-free screw compressor according to claim 2, wherein the connection space of the atmosphere communication portion is sectioned into a first sectioning region and a second sectioning region by a partitioning wall, wherein the first communication portion communicates with the first sectioning region, wherein the second communication portion communicates with the second sectioning region, and wherein each of the first sectioning region and the second sectioning region includes an external communication portion communicating with the atmosphere outside of the casing.

5. The oil-free screw compressor according to claim 4, wherein the external communication portion corresponding to the second sectioning region is located downwardly of the external communication portion corresponding to the first sectioning region.

6. The oil-free screw compressor according to claim 1, wherein the first communication portion is provided so as to be higher than the second communication portion.

7. The oil-free screw compressor according to claim 1, wherein the second communication portion includes a plurality of second communication portions, and wherein the angular positions of the plurality of second communication portions with respect to the rotation center of the shaft are different.

8. The oil-free screw compressor according to claim 1, wherein the flow passage sectional area of the first communication portion is larger than a flow passage sectional area between a portion provided on the bearing side with respect to the first communication portion and on the screw side with respect to the second communication portion and sectioning a space in which the first and second communication portions communicate with each other and the shaft.

9. The oil-free screw compressor according to claim 1, wherein the first shaft seal device and the second shaft seal device engage with each other so as to partially overlap with each other when seen in a diameter direction of the screw rotor.

* * * * *